US007654827B2

(12) United States Patent
Arai et al.

(10) Patent No.: US 7,654,827 B2
(45) Date of Patent: Feb. 2, 2010

(54) ELECTRICAL CONNECTOR HAVING A SPACE ALLOWING AN ELASTIC CONNECTING MEMBER TO BE ESCAPED

(75) Inventors: Katsumi Arai, Tokyo (JP); Seiya Matsuo, Tokyo (JP); Akane Yoneta, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/895,862

(22) Filed: Aug. 28, 2007

(65) Prior Publication Data

US 2008/0057757 A1 Mar. 6, 2008

(30) Foreign Application Priority Data

Aug. 29, 2006 (JP) ..... 2006-232742

(51) Int. Cl.
*H01R 12/00* (2006.01)

(52) U.S. Cl. ..... 439/66; 439/65

(58) Field of Classification Search ..... 439/66, 439/74, 91, 55, 65
See application file for complete search history.

(56) References Cited

U.S. PATENT DOCUMENTS 3,551,750 A * 12/1970 Sterling ..... 361/787
3,851,297 A * 11/1974 Munro ..... 439/591
4,257,661 A * 3/1981 Dalamangas et al. ..... 439/91
4,402,562 A * 9/1983 Sado ..... 439/91
5,306,163 A * 4/1994 Asakawa ..... 439/74
5,791,912 A * 8/1998 Riechelmann et al. ..... 439/66
5,931,689 A * 8/1999 Patel ..... 439/346
6,077,089 A * 6/2000 Bishop et al. ..... 439/66
6,293,805 B1 * 9/2001 Wu ..... 439/66
6,488,513 B1 * 12/2002 Neidich et al. ..... 439/66
6,814,587 B2 * 11/2004 Ma ..... 439/66
6,881,070 B2 * 4/2005 Chiang ..... 439/66
7,113,408 B2 * 9/2006 Brown et al. ..... 361/773
7,118,388 B2 * 10/2006 Midorikawa et al. ..... 439/74
7,118,393 B1 * 10/2006 Pupkiewicz et al. ..... 439/91
7,303,403 B2 * 12/2007 Kuwahara ..... 439/66

(Continued)

FOREIGN PATENT DOCUMENTS

JP 07-037633 2/1995

(Continued)

OTHER PUBLICATIONS

Japanese Office Action dated Jul. 23, 2008.

(Continued)

*Primary Examiner*—T C Patel
*Assistant Examiner*—Harshad C Patel
(74) *Attorney, Agent, or Firm*—Collard & Roe, P.C.

(57) ABSTRACT

In an electrical connector for connecting connection objects to each other in a connecting direction, a holding member has an accommodating portion between a first and a second surface to which the connection objects are opposed, respectively, when connected to said electrical connector. A connecting member has elasticity and is placed in the accommodating portion. The holding member includes a first and a second wall which define the accommodating portion therebetween. At least one of the first and the second walls includes a restraining portion defining a space which allows a portion of the connecting member to elastically move in a predetermined direction crossing the connecting direction.

24 Claims, 17 Drawing Sheets

U.S. PATENT DOCUMENTS

| | | | | |
|---|---|---|---|---|
| 7,329,130 | B2 * | 2/2008 | Saito et al. | 439/66 |
| 7,335,068 | B2 * | 2/2008 | Dwan et al. | 439/700 |
| 7,338,294 | B2 * | 3/2008 | Polnyi | 439/66 |
| 7,341,485 | B2 * | 3/2008 | Polnyi | 439/591 |
| 2004/0157478 | A1 * | 8/2004 | Midorikawa et al. | 439/74 |
| 2006/0024987 | A1 * | 2/2006 | Huang et al. | 439/66 |

FOREIGN PATENT DOCUMENTS

| | | |
|---|---|---|
| JP | 2002-008810 | 1/2002 |
| JP | 2002 252044 | 9/2002 |
| JP | 2003 185700 | 7/2003 |
| JP | 2005-228504 | 8/2005 |

OTHER PUBLICATIONS

Japanese Office Action dated Nov. 12, 2008.

* cited by examiner

ELECTRICAL CONNECTOR HAVING A SPACE ALLOWING AN ELASTIC CONNECTING MEMBER TO BE ESCAPED

This application is based upon and claims the benefit of priority from Japanese patent application No. 2006-232742, filed on Aug. 29, 2006, the disclosure of which is incorporated herein in its entirety by reference.

BACKGROUND OF THE INVENTION

This invention relates to an electrical connector having a connecting member for connection between a connection object and a mating connection object.

As a related art, Japanese Unexamined Patent Application Publication (JP-A) No. 2002-252044 (Patent Document 1) discloses an electrical connector having contacts adapted to be disposed between two mounting boards and restraining portions serving to restrain inclination of the contacts due to bending thereof, respectively.

In this electrical connector, the contacts made of a conductive elastomer material are elastically compressed to thereby achieve electrical connection between the mounting boards. The restraining portions restrain the inclination of the contacts due to bending thereof when the contacts are pressed between the mounting boards to be elastically compressed.

Further, as a related art, Japanese Unexamined Patent Application Publication (JP-A) No. 2003-185700 (Patent Document 2) discloses an IC socket having contacts for connection between an IC and a socket board.

Each contact comprises a device-side electrode for contact with the IC, a board-side electrode for contact with the socket board, a transmission line electrically connecting the device-side electrode and the board-side electrode to each other, and an elastic member provided between the device-side electrode and the board-side electrode.

Each contact further comprises an elastic support sandwiched between a device-side insulating plate of the elastic member and a board-side insulating plate of the elastic member. The device-side electrode and the board-side electrode are disposed so as to be opposed to each other.

In the electrical connector of Patent Document 1, the deformation shape of each contact cannot be controlled at the time of the compression. Therefore, pressure contact loads of the contacts are unstable and thus there is a problem that the contact reliability is poor.

Further, in the electrical connector of Patent Document 1, there is a problem that when the contacts are compressed, contact portions of the adjacent contacts are brought into contact with each other to be shorted together.

Incidentally, as the interval between contact portions of each mounting board decreases, the possibility increases that the contact portions of the adjacent contacts are brought into contact with each other to be shorted together.

In the IC socket of Patent Document 2, since each contact has the elastic member, the elastic support, and so on, the structure becomes complicated.

Further, in the IC socket of Patent Document 2, the deformation shape of each contact cannot be controlled at the time of compression. Therefore, pressure contact loads of the contacts are unstable and thus there is a problem that the contact reliability is poor.

SUMMARY OF THE INVENTION

It is therefore an exemplary object of this invention to provide an electrical connector capable of making the pressure contact load stable and further capable of improving the contact reliability.

It is another exemplary object of this invention to provide an electrical connector capable of preventing a short circuit between contact portions.

Other objects of the present invention will become clear as the description proceeds.

According to an exemplary aspect of the present invention, there is provided an electrical connector for connecting connection objects to each other in a connecting direction, the electrical connector comprising a holding member having an accommodating portion between a first and a second surface to which the connection objects are opposed, respectively, when connected to said electrical connector, and a connecting member having elasticity and placed in the accommodating portion, wherein the holding member comprises a first and a second wall which define the accommodating portion therebetween, and at least one of the first and the second walls comprises a restraining portion defining a space which allows a portion of the connecting member to elastically move in a predetermined direction crossing the connecting direction.

BRIEF DESCRIPTION OF THE DRAWINGS

FIG. 5A is a sectional view for explaining a state before connecting a connection object and a mating connection object to each other using the electrical connector shown in FIG. 3, while.

FIGS. 6A and 6B show an electrical connector according to a second exemplary embodiment of this invention, wherein FIG. 6A is a sectional view for explaining a state before connecting a connection object and a mating connection object to each other using the electrical connector, while, FIG. 6B is a sectional view for explaining a state after connecting the connection object and the mating connection object to each other using the electrical connector shown in FIG. 6A;

FIGS. 7A and 7B show an electrical connector according to a third exemplary embodiment of this invention, wherein FIG. 7A is a sectional view for explaining a state before connecting a connection object and a mating connection object to each other using the electrical connector, while, FIG. 7B is a sectional view for explaining a state after connecting the connection object and the mating connection object to each other using the electrical connector shown in FIG. 7A;

FIGS. 13A and 13B show an electrical connector according to a fourth exemplary embodiment of this invention, wherein FIG. 13A is a sectional view for explaining a state before connecting a connection object and a mating connection object to each other using the electrical connector, while, FIG. 13B is a sectional view for explaining a state after connecting the connection object and the mating connection object to each other using the electrical connector shown in FIG. 13A;

FIGS. 14A and 14B show an electrical connector according to a fifth exemplary embodiment of this invention, wherein FIG. 14A is a sectional view for explaining a state before connecting a connection object and a mating connection object to each other using the electrical connector, while, FIG. 14B is a sectional view for explaining a state after connecting the connection object and the mating connection object to each other using the electrical connector shown in FIG. 14A;

FIGS. 15A and 15B show an electrical connector according to a sixth exemplary embodiment of this invention, wherein FIG. 15A is a sectional view for explaining a state before connecting a connection object and a mating connection object to each other using the electrical connector, while, FIG. 15B is a sectional view for explaining a state after connecting the connection object and the mating connection object to each other using the electrical connector shown in FIG. 15A;

FIGS. 16A and 16B show an electrical connector according to a seventh exemplary embodiment of this invention, wherein FIG. 16A is a sectional view for explaining a state before connecting a connection object and a mating connection object to each other using the electrical connector, while, FIG. 16B is a sectional view for explaining a state after connecting the connection object and the mating connection object to each other using the electrical connector shown in FIG. 16A;

FIGS. 17A and 17B show an electrical connector according to an eighth exemplary embodiment of this invention, wherein FIG. 17A is a sectional view for explaining a state before connecting a connection object and a mating connection object to each other using the electrical connector, while, FIG. 17B is a sectional view for explaining a state after connecting the connection object and the mating connection object to each other using the electrical connector shown in FIG. 17A;

FIGS. 18A and 18B show an electrical connector according to a ninth exemplary embodiment of this invention, wherein FIG. 18A is a sectional view for explaining a state before connecting a connection object and a mating connection object to each other using the electrical connector, while, FIG. 18B is a sectional view for explaining a state after connecting the connection object and the mating connection object to each other using the electrical connector shown in FIG. 18A;

FIGS. 19A and 19B show an electrical connector according to a tenth exemplary embodiment of this invention, wherein FIG. 19A is a sectional view for explaining a state before connecting a connection object and a mating connection object to each other using the electrical connector, while, FIG. 19B is a sectional view for explaining a state after connecting the connection object and the mating connection object to each other using the electrical connector shown in FIG. 19A;

FIGS. 20A and 20B show an electrical connector according to an eleventh exemplary embodiment of this invention, wherein FIG. 20A is a sectional view for explaining a state before connecting a connection object and a mating connection object to each other using the electrical connector, while, FIG. 20B is a sectional view for explaining a state after connecting the connection object and the mating connection object to each other using the electrical connector shown in FIG. 20A; and FIGS. 21A and 21B show an electrical connector according to a twelfth exemplary embodiment of this invention, wherein FIG. 21A is a sectional view for explaining a state before connecting a connection object and a mating connection object to each other using the electrical connector, while, FIG. 21B is a sectional view for explaining a state after connecting the connection object and the mating connection object to each other using the electrical connector shown in FIG. 21A.

DESCRIPTION OF THE PREFERRED EMBODIMENTS

Figure 1:
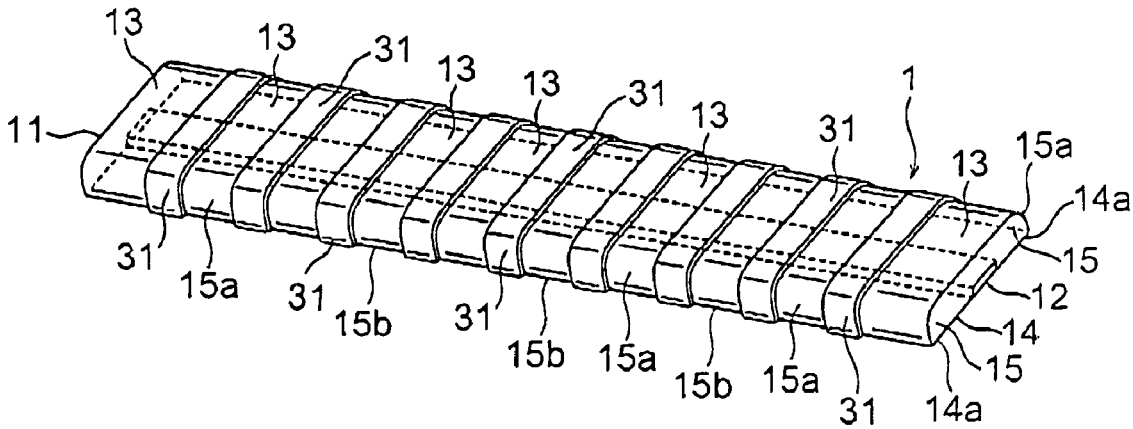
FIG. 1 is a perspective view showing a connecting member for use in an electrical connector according to an exemplary embodiment of this invention.

FIG. 1 shows a connecting member 1 used in an electrical connector according to this invention. Referring to FIG. 1, the connecting member 1 includes an insulating elastic body 11, a reinforcing member 12 for reinforcing the elastic body 11, and a plurality of conductors 31 disposed at predetermined positions on the elastic body 11.

The elastic body 11 has a generally elongated plate shape. The elastic body 11 has a holding surface 13 and a flat base surface 14 opposed to the holding surface 13. Further, the elastic body 11 has a pair of projecting portions 15 each formed in a width direction of the elastic body 11 perpendicular to its longitudinal direction.

Each projecting portion 15 has a flat projecting base surface 14*a*, a curved surface 15*a* formed in a generally circular-arc shape, and a side surface 15*b* connecting together the curved surface 15*a* and the projecting base surface 14*a*.

Each projecting base surface 14*a* extends in the width direction from a corresponding one of width-direction sides of the base surface 14. The curved surface 15*a* extends in the generally circular-arc shape from the holding surface 13 toward a side of the projecting base surface 14*a*. The side surface 15*b* is located in a direction perpendicular to the projecting base surface 14*a* to connect the curved surface 15*a* and the projecting base surface 14*a* to each other.

The reinforcing member 12 has an elongated plate shape. The reinforcing member 12 is located in the middle in the width direction of the base surface 14 and extends in the longitudinal direction of the elastic body 11. The reinforcing member 12 is buried in the elastic body 11. One surface of the reinforcing member 12 is exposed so as to be flush with the projecting base surfaces 14*a*.

The conductors 31 are each disposed on the holding surface 13, the curved surfaces 15*a*, and the side surfaces 15*b* in the width direction perpendicular to the longitudinal direction so as to form a belt-like wiring pattern (predetermined pattern). The conductors 31 are arranged parallel to each other at a predetermined distance from each other in the longitudinal direction of the elastic body 11.

A portion, disposed at the projecting portion 15 on one side, of each conductor 31 serves as a portion for contact with a corresponding one of contact portions of a connection object (not shown), while, a portion, disposed at the projecting portion 15 on the other side, of each conductor 31 serves as a portion for contact with a corresponding one of mating contact portions of a mating connection object (not shown). That is, the connection object and the mating connection object are connected together by being brought into contact with the portions of the conductors 31 disposed at the pair of projecting portions 15.

Each conductor 31 is in the form of a thin metal film. The conductor 31 can be disposed on the elastic body 11 by forming the thin metal film on the holding surface 13, the curved surfaces 15*a*, and the side surfaces 15*b*. Specifically, the conductor 31 can be obtained by laminating the thin metal film on a several-micron basis on the elastic body 11 using a microfabrication technique. As the microfabrication technique, use can be made of plating, sputtering, etching, or the like.

The conductors 31 can be arranged at a distance of, for example, 0.5 mm or less from each other in the longitudinal direction of the elastic body 11. Therefore, the conductors 31 can be disposed on the elastic body 11 at a narrow pitch.

As a material of the elastic body 11, it is preferable to use a mainly silicon-based heat-resistant rubber. The elastic body 11 can be formed by molding. Instead of the rubber, the elastic body 11 may be made of a gel material.

Bonding between the elastic body 11 and the conductors 31 can be achieved by a method of coating one of an adhesive and a coupling agent.

The reinforcing member 12 is made of a metal, a hard resin, or the like. At the time of molding the elastic body 11, the reinforcing member 12 is buried in the elastic body 11 so that one surface of the reinforcing member 12 is exposed to be flush with the projecting base surfaces 14*a*.

Figure 2:
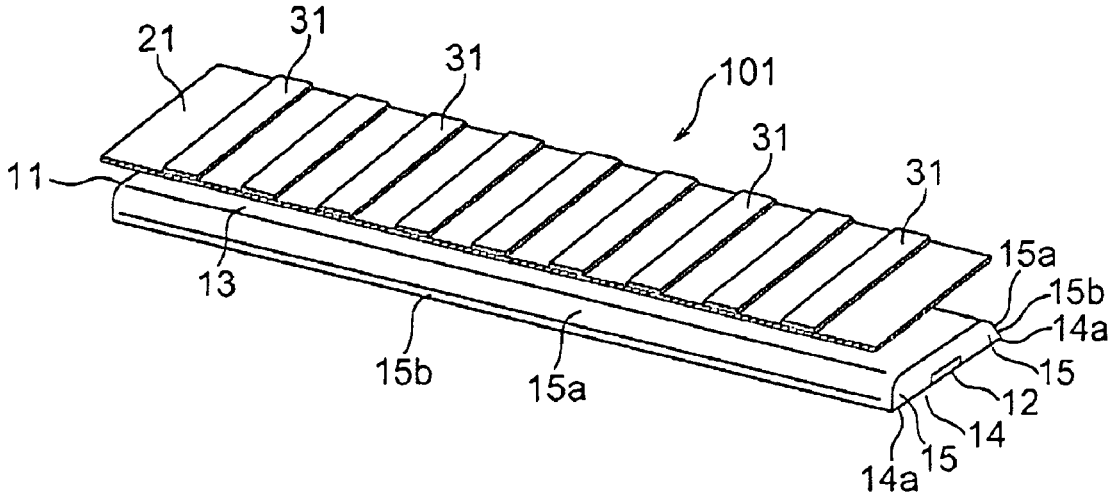
FIG. 2 is a perspective view showing a connecting member, different from the connecting member shown in FIG. 1, in a disassembled state as a connecting member for use in an electrical connector according to an exemplary embodiment of this invention.

FIG. 2 shows, in a disassembled state, a connecting member 101 that partly differs in structure from the connecting member 1 shown in FIG. 1. Since an elastic body 11 and a reinforcing member 12 of the connecting member 101 shown in FIG. 2 are the same in structure as those of the connecting member 1 shown in FIG. 1, explanation thereof is omitted by assigning the same reference symbols thereto.

Referring to FIG. 2, the connecting member 101 includes the elastic body 11, the reinforcing member 12, an insulating film 21 held on the elastic body 11, and a plurality of conductors 31 disposed at predetermined positions on the film 21.

The elastic body 11 has the same shape as that of the elastic body 11 explained with reference to FIG. 1. The film 21 is fixedly bonded to a holding surface 13 of the elastic body 11. The conductors 31 are arranged on one surface of the film 21 at a predetermined distance from each other in a longitudinal direction of the film 21. The conductors 31 are each disposed on the film 21 so as to form a belt-like wiring pattern (predetermined pattern) in a width direction of the film 21 perpendicular to its longitudinal direction. That is, the conductors 31 are arranged parallel to each other at the predetermined distance from each other in the longitudinal direction of the film 21.

Further, the conductors 31 are each disposed on the film 21 so as to correspond to the holding surface 13 of the elastic body 11 and curved surfaces 15*a* and side surfaces 15*b* of a pair of projecting portions 15 of the elastic body 11 in the width direction of the film 21 perpendicular to its longitudinal direction.

A portion, opposed to the curved surface 15*a* and the side surface 15*b* of the projecting portion 15 on one side of the elastic body 11, of each conductor 31 disposed on the film 21 serves as a portion for contact with a corresponding one of contact portions of a connection object (not shown), while, a portion, opposed to the curved surface 15*a* and the side surface 15*b* of the projecting portion 15 on the other side of the elastic body 11, of each conductor 31 disposed on the film 21 serves as a portion for contact with a corresponding one of mating contact portions of a mating connection object (not shown).

The conductors 31 are obtained by patterning a thin metal film on the film 21. In this event, the conductors 31 are each arranged at a position corresponding to the holding surface 13, the curved surfaces 15*a*, and the side surfaces 15*b* of the elastic body 11.

Formation of the thin metal film on the film 21 is carried out using the same microfabrication technique as that for forming the thin metal film on the elastic body 11 as described above with reference to FIG. 1.

Therefore, the thin metal film can be laminated on the film 21 on a several-micron basis. Further, the conductors 31 can be arranged at a distance of, for example, 0.5 mm or less from each other in the longitudinal direction of the elastic body 11 and thus can be arranged at a narrow pitch.

As the film 21 with the conductors 31, use can be made of an FPC (flexible printed circuit) with conductors 31.

The film 21 with the conductors 31 disposed thereon is fixedly bonded to the elastic body 11. That is, the film 21 is fixedly bonded to the holding surface 13 of the elastic body 11 so as to follow elastic deformation of the elastic body 11.

The elastic body 11 and the film 21 can be fixed to each other by bonding them together entirely or partially. The bonding between the elastic body 11 and the film 21 can be achieved by coating one of an adhesive, a gluing agent, and a coupling agent on at least one of the elastic body 11 and the film 21.

The bonding between the elastic body 11 and the film 21 can also be achieved by ultrasonic welding or laser welding. As the film 21, it is preferable to use one of a polyimide resin, an aramid resin, and the like.

Figure 3:
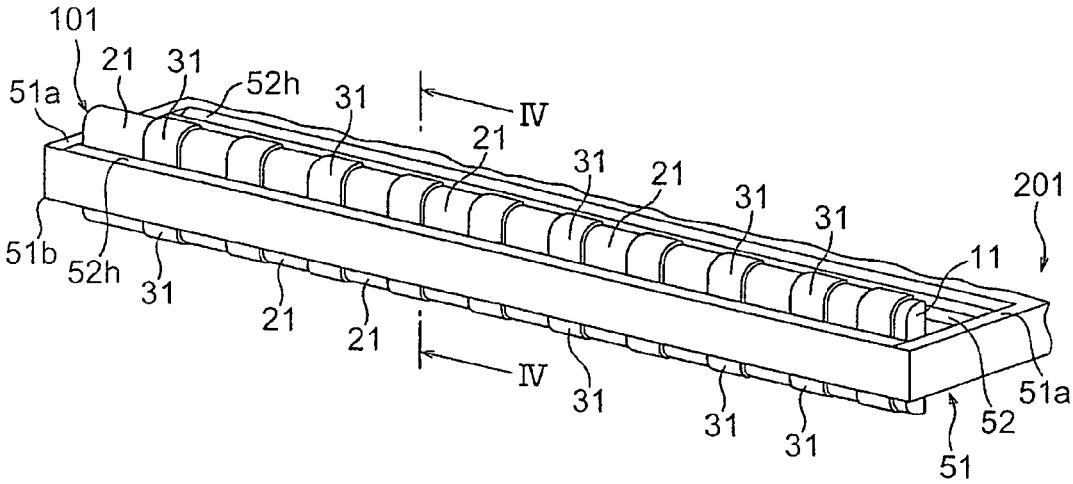
FIG. 3 is a perspective view showing an electrical connector, having the connecting member shown in FIG. 2, according to a first exemplary embodiment of this invention.

Either of the connecting members 1 and 101 described above with reference to FIGS. 1 and 2, respectively, can be used as one component of an electrical connector 201 shown in FIG. 3 as a first exemplary embodiment of this invention. In the following description of each of exemplary embodiments of this invention, an electrical connector will be referred to simply as a connector.

First Exemplary Embodiment

Figure 4:
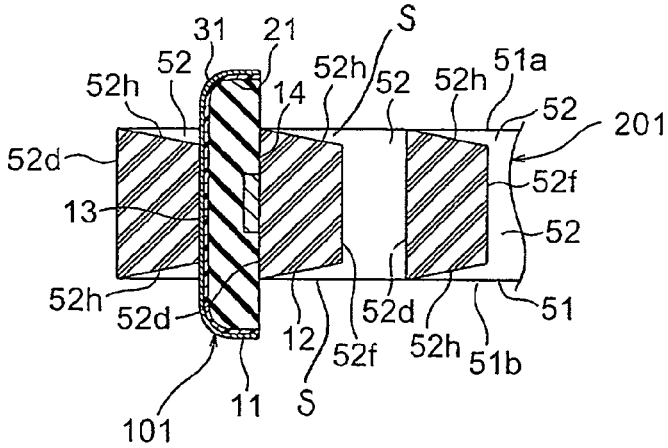
FIG. 4 is a sectional view taken along line IV-IV of the electrical connector shown in FIG. 3.

FIGS. 3 and 4 show the connector 201 as the first exemplary embodiment employing the connecting member 101 described above with reference to FIG. 2.

The connector 201 includes the connecting member 101 and a plate-shaped holding member (frame member) 51 holding the connecting member 101. The holding member 51 has a plurality of accommodating portions 52 for accommodating a plurality of connecting members 101 individually. Each accommodating portion 52 vertically passes through the holding member 51 including its upper and lower surfaces 51*a* and 51*b* opposed to each other.

As shown in FIG. 4, each accommodating portion 52 is defined by a first wall 52*d*, a second wall 52*f* opposed to the first wall 52*d*, and a pair of restraining portions 52*h*. Each restraining portion 52*h* provides, in the accommodating portion 52, a space (escape portion) S for allowing a portion of the connecting member 101 to move in a predetermined direction.

The first wall 52*d* is a portion that faces the base surface 14 being one side of the connecting member 101. The second wall 52*f* is a portion that faces an intermediate portion of the holding surface 13 being the other side of the elastic body 11.

One of the restraining portions 52*h* is an inclined surface connecting between an upper side of the first wall 52*d* and an upper side of the second wall 52*f*. The other of the restraining portions 52*h* is an inclined surface connecting between a lower side of the first wall 52*d* and a lower side of the second wall 52*f*.

The height of the first wall 52*d* is set to be greater than that of the second wall 52*f* in a connecting direction A in which a connection object and a mating connection object are connected to each other. Therefore, the pair of restraining portions 52*h* are located in each accommodating portion 52.

As shown in FIG. 4, the holding member 51 between the adjacent accommodating portions 52 has a section that is tapered due to the pair of restraining portions 52*h*. That is, in the section as shown in FIG. 4, the holding member 51 has a tapered shape inclined so as to taper from the first wall 52*d* to the second wall 52*f* between the adjacent accommodating portions 52. That is, the section of the holding member 51 between the adjacent accommodating portions 52 has a trapezoidal shape oriented sideways, i.e. rotated by 90 degrees.

As shown in FIGS. 3 and 4, the connecting member 101 is inserted in the accommodating portion 52 so that the base surface 14 of the elastic body 11 faces the first wall 52*d*. In this event, the intermediate portion of the holding surface 13 of the elastic body 11 faces the second wall 52*f*. That is, the holding surface 13 faces the second wall 52*f* through the conductors 31 disposed on the film 21.

When the connecting member 101 is accommodated in the accommodating portion 52, the base surface 14 and the intermediate portion of the holding surface 13 of the connecting member 101 are held sandwiched under pressure between the first and second walls 52*d* and 52*f*. In this state, one of the projecting portions 15 of the connecting member 101 is located above the upper surface 51*a* of the holding member 51, while, the other projecting portion 15 of the connecting member 101 is located below the lower surface 51*b* of the holding member 51.

The connecting member 101 can be cut to a predetermined dimension in its longitudinal direction so as to match the dimension of the accommodating portion 52 in its longitudinal direction. Therefore, the connecting member 101 can be held in the accommodating portion 52 having a predetermined dimension in its longitudinal direction.

Figure 5B:
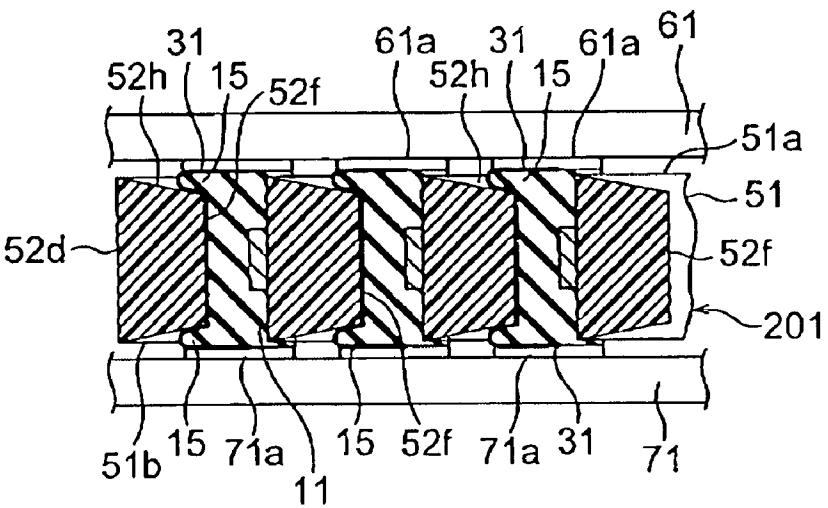
FIG. 5B is a sectional view for explaining a state after connecting the connection object and the mating connection object to each other using the electrical connector shown in FIG. 5A.
Figure 5A:
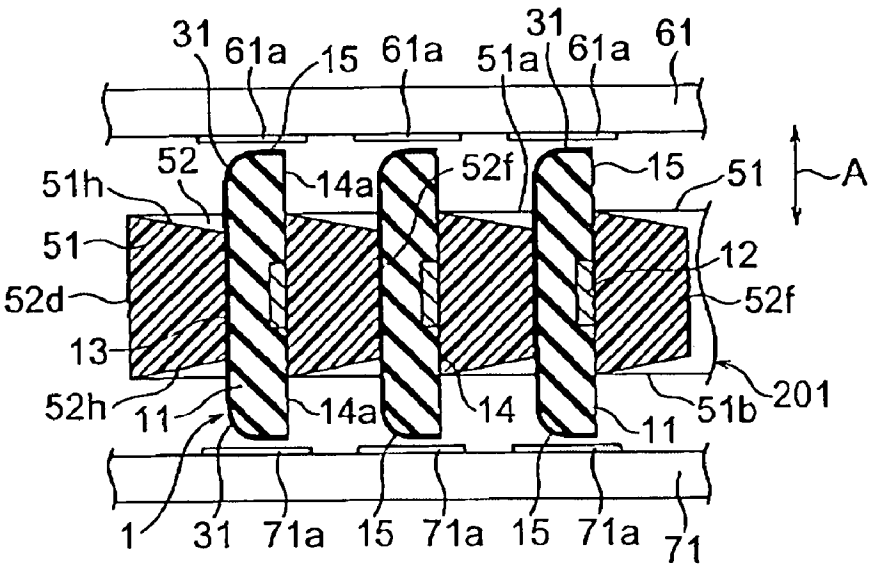

FIG. 5A shows the connector 201 holding the connecting members 1, shown in FIG. 1, in three of the accommodating portions 52 of the holding member 51 shown in FIGS. 3 and 4.

The connector 201 is placed between a connection object 61 being a wiring board and a mating connection object 71 being a mating wiring board. The connection object 61 and the mating connection object 71 are placed parallel to each other in a vertical direction (connecting direction A) in FIG. 5A. Each connecting member 1 is disposed in the connecting direction A so that the pair of projecting portions 15 are located on the upper and lower sides. The connecting direction A is a direction perpendicular to the board surfaces of the connection object 61 and the mating connection object 71.

Those portions, disposed on the curved surface 15*a* and the side surface 15*b* of the projecting portion 15 on one side of each connecting member 1, of the conductors 31 are brought into contact with corresponding contact portions 61*a* of the connection object 61 on the upper side in the connecting direction A. On other hand, those portions, disposed on the curved surface 15*a* and the side surface 15*b* of the projecting portion 15 on the other side of each connecting member 1, of the conductors 31 are brought into contact with corresponding mating contact portions 71*a* of the mating connection object 71 on the lower side in the connecting direction A.

The connection object 61 and the mating connection object 71 are relatively moved so as to shorten the distance therebetween in the connecting direction A from the state shown in FIG. 5A. In this event, as shown in FIG. 5B, the connecting members 1 are pressed by the connection object 61 and the mating connection object 71 so as to be elastically compressed. Simultaneously, the conductors 31 are brought into contact with the contact portions 61*a* and the mating contact portions 71*a*. Further, portions of each pair of projecting portions 15 are deformed in predetermined directions due to the compression so as to move into the spaces defined on the restraining portions 52*h*.

That is, the intermediate portion, in the connecting direction A, of each elastic body 11 is sandwiched between the first and second walls 52*d* and 52*f* of the holding member 51 and thus has no portion that can escape at the time of the compression. Consequently, the portions of each pair of projecting portions 15 move into the spaces on the restraining portions 52*h* due to the compression. In this event, since the conductors 31 of the adjacent connecting members 1 stay in the spaces on the restraining portions 52*h*, a short circuit due to contact can be prevented.

Further, when connecting the connection object 61 and the mating connection object 71 to each other, even if the pitch of the contact portions 61*a* and the pitch of the mating contact portions 71*a* are narrow, it is possible to prevent a short circuit between the adjacent contact portions 61*a* and a short circuit between the adjacent mating contact portions 71*a*. That is, since the portions of each pair of projecting portions 15 move into the spaces on the restraining portions 52*h* at the time of the compression, the conductors 31 can be prevented from short-circuiting the adjacent contact portions 61*a* in the pitch direction and short-circuiting the adjacent mating contact portions 71*a* in the pitch direction. The pitch direction is a direction perpendicular to the connecting direction A in FIG. 5A.

Even in the case of the combination of the connecting members 101 and the holding member 51 described above with reference to FIGS. 3 and 4, the connector 201 of the first exemplary embodiment operates in the contact manner described above with reference to FIG. 5B. Therefore, when the structure with the combination of the connecting members 101 and the holding member 51 is employed, it is possible to obtain the same effect as that described above with reference to FIG. 5B.

Second Exemplary Embodiment

Figure 6B:
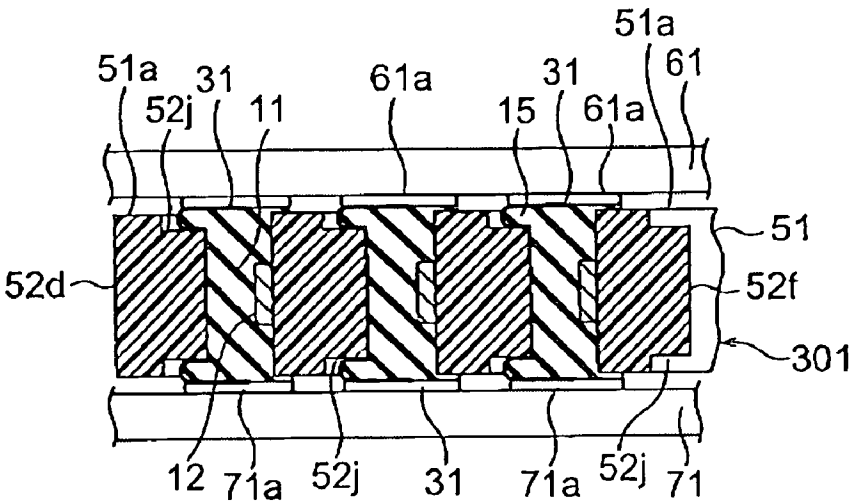
Figure 6A:
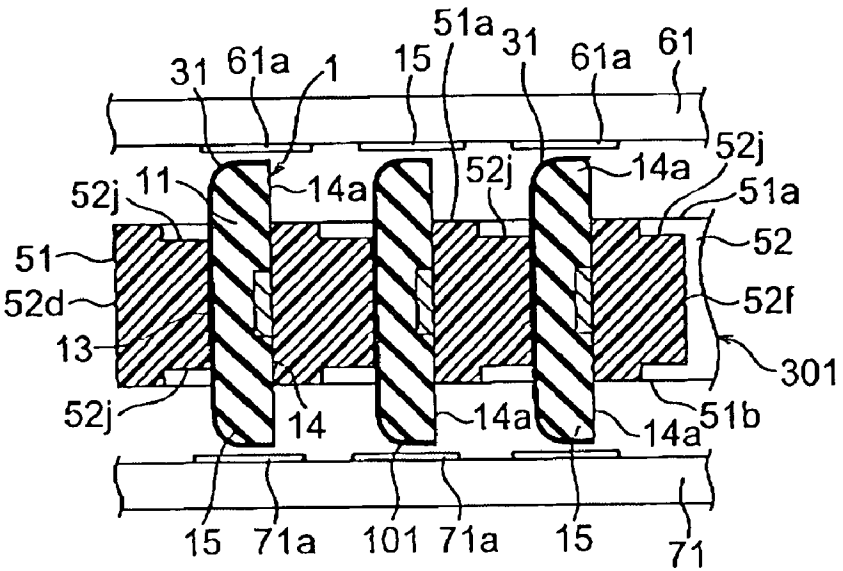

FIGS. 6A and 6B show a connector 301 according to a second exemplary embodiment of this invention, wherein the connector 301 employs the connecting members 1 described above with reference to FIG. 1. In the connector 301 of the second exemplary embodiment, the shape of each of accommodating portions 52 of a holding member 51 is changed from that described above in the first exemplary embodiment. The other structure is the same as that of the first exemplary embodiment. Therefore, explanation of those portions other than the accommodating portions 52 is omitted.

FIG. 6A shows the connector 301 holding the connecting members 1 in three of the accommodating portions 52, respectively.

Each accommodating portion 52 includes a first wall 52*d* that faces the base surface 14 of the elastic body 11, a second wall 52*f* that faces the holding surface 13 of the elastic body 11, and a pair of restraining portions 52*j*.

The height of the first wall 52*d* is set to be greater than that of the second wall 52*f* so that each restraining portion 52*j* has a shape with a stepped surface. In the section of the holding member 51 as shown in FIG. 6A, each restraining portion 52*j* forms a surface that is located below an upper surface 51*a* of the holding member 51 and above a lower surface 51*b* of the holding member 51. That is, each restraining portion 52*j* has the shape formed with the stepped surface parallel to the upper and lower surfaces 51*a* and 51*b* of the holding member 51. Therefore, the pair of restraining portions 52*j* are located in each accommodating portion 52.

Each connecting member 1 is inserted between the first wall 52*d* and the second wall 52*f* so that its intermediate portion in the connecting direction A faces the first and second walls 52*d* and 52*f*. In this state, one of the projecting portions 15 of the elastic body 11 is located above the upper surface 51*a* of the holding member 51, while, the other projecting portion 15 of the elastic body 11 is located below the lower surface 51*b* of the holding member 51.

The connector 301 is placed between a connection object 61 and a mating connection object 71. The connection object 61 and the mating connection object 71 are placed parallel to each other. Each connecting member 1 is disposed in the connecting direction A so that the pair of projecting portions 15 are located on the upper and lower sides.

Those portions, disposed at the projecting portion 15 on one side, of the conductors 31 are brought into contact with corresponding contact portions 61*a* of the connection object 61. On other hand, those portions, disposed at the projecting portion 15 on the other side, of the conductors 31 are brought into contact with corresponding mating contact portions 71*a* of the mating connection object 71. By relatively moving the connection object 61 and the mating connection object 71 so as to shorten the distance therebetween, the connection object 61 and the mating connection object 71 are brought into contact with the conductors 31 as shown in FIG. 6B.

As shown in FIG. 6B, when the connection object 61 and the mating connection object 71 are relatively moved so as to shorten the distance therebetween, the connecting members 1 are compressed in the connecting direction A by the connection object 61 and the mating connection object 71. At the time of the compression, the contact portions 61*a* and the mating contact portions 71*a* are brought into contact with the conductors 31. Simultaneously, portions of each pair of projecting portions 15 are deformed in predetermined directions due to the compression so as to move into spaces defined on the restraining portions 52*j*.

That is, the intermediate portion, in the connecting direction A, of each elastic body 11 is sandwiched between the first and second walls 52*d* and 52*f* of the holding member 51 and thus has no portion that can escape at the time of the compression. Consequently, the portions of each pair of projecting portions 15 move into the spaces on the restraining portions 52*j* due to the compression.

Since the deformed portions of the projecting portions 15 move into the spaces on the restraining portions 52*j* after the connection object 61 and the mating connection object 71 are connected together by the connecting members 1, the conductors 31 of the adjacent connecting members 1 are prevented from being short-circuited with each other.

Further, when connecting the connection object 61 and the mating connection object 71 to each other, even if the pitch of the contact portions 61*a* and the pitch of the mating contact portions 71*a* are narrow, it is possible to prevent a short circuit between the adjacent contact portions 61*a* and a short circuit between the adjacent mating contact portions 71*a*. That is, since the portions of each pair of projecting portions 15 move into the spaces on the restraining portions 52*j* at the time of the compression, the conductors 31 can be prevented from short-circuiting the adjacent contact portions 61*a* in the pitch direction and short-circuiting the adjacent mating contact portions 71*a* in the pitch direction.

Even in the case of the combination of the connecting members 101 and the holding member 51 described above with reference to FIGS. 2 to 4, the connector 301 of the second exemplary embodiment operates in the contact manner described above with reference to FIG. 6B. Therefore, when the structure with the combination of the connecting members 101 and the holding member 51 is employed, it is possible to obtain the same effect as that described above with reference to FIG. 6B.

Third Exemplary Embodiment

Figure 7B:
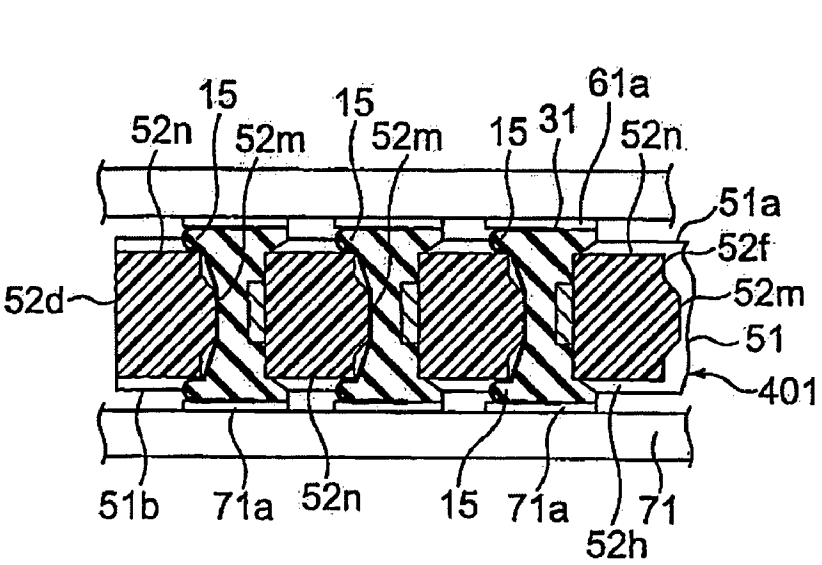
Figure 7A:
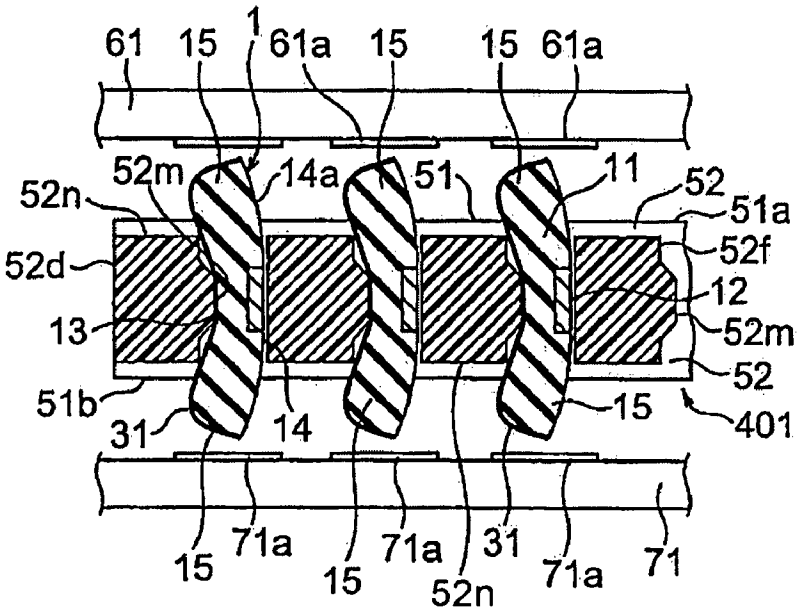

FIGS. 7A and 7B show a connector 401 according to a third exemplary embodiment of this invention, wherein the connector 401 employs the connecting members 1 described above with reference to FIG. 1. In the connector 401 of the third exemplary embodiment, the shape of each of accommodating portions 52 of a holding member 51 is changed from that of the connector 201 described above in the first exemplary embodiment. Therefore, explanation of those portions other than the accommodating portions 52 is omitted.

Referring to FIG. 7A, each accommodating portion 52 has a first wall 52*d* that faces the base surface 14 being one side of the connecting member 1, a second wall 52*f* that faces the holding surface 13 of the elastic body 11, an additional restraining portion 52*m* projecting from the second wall 52*f*, and a pair of restraining portions 52*n*.

The additional restraining portion 52*m* has a protruding shape for pushing and deforming the conductors 31 in a predetermined direction crossing the connecting direction A when the connecting member 1 is held by the holding member 51. That is, in the section of the holding member 51 as shown in FIG. 7A, the additional restraining portion 52*m* projects from the second wall 52*f* in the direction crossing the connecting direction A.

As shown in FIG. 7A, in the section of the holding member 51, each restraining portion 52*n* forms a surface that is located below an upper surface 51*a* of the holding member 51 and above a lower surface 51*b* of the holding member 51 and that is parallel to the upper and lower surfaces 51*a* and 51*b*. Therefore, the pair of restraining portions 52*n* are located in each accommodating portion 52.

As shown in FIG. 7A, each connecting member 1 is inserted in the accommodating potion 52 so as to face the first wall 52*d* and the second wall 52*f*, respectively. In this state, since the additional restraining portion 52*m* pushes the middle portion of the holding surface 13 of the elastic body 11, the connecting member 1 is held in the accommodating portion 52 with the pair of projecting portions 15 being slightly bent in the direction crossing the connecting direction A.

In the connector 401, one of the projecting portions 15 of each connecting member 1 is located outside the upper surface 51*a* of the holding member 51, while, the other projecting portion 15 is located outside the lower surface 51*b* of the holding member 51.

Those portions, disposed at the projecting portion 15 on one side, of the conductors 31 are brought into contact with corresponding contact portions 61*a* of a connection object 61. On other hand, those portions, disposed at the projecting portion 15 on the other side, of the conductors 31 are brought into contact with corresponding mating contact portions 71*a* of a mating connection object 71. That is, by relatively moving the connection object 61 and the mating connection object 71 so as to shorten the distance therebetween, the connection object 61 and the mating connection object 71 are brought into contact with the conductors 31 as shown in FIG. 7B.

As shown in FIG. 7B, when the connection object 61 and the mating connection object 71 are relatively moved so as to shorten the distance therebetween, the connecting members 1 are compressed by the connection object 61 and the mating connection object 71. In this event, the contact portions 61*a* and the mating contact portions 71*a* are brought into contact with the conductors 31. Portions of each pair of projecting portions 15 are deformed in predetermined directions crossing the connecting direction A due to the compression so as to move into spaces defined on the restraining portions 52*n* of the holding member 51.

Since the deformed portions of the projecting portions 15 move in the predetermined directions into the spaces on the restraining portions 52*n* after the connection object 61 and the mating connection object 71 are connected together by the connecting members 1, the conductors 31 of the adjacent connecting members 1 are prevented from being short-circuited with each other.

Further, at the time of the connection, even if the pitch of the contact portions 61*a* and the pitch of the mating contact portions 71*a* are narrow, the portions of each pair of projecting portions 15 move into the spaces on the restraining portions 52*n* due to the compression.

Therefore, the conductors 31 of each connecting member 1 can be prevented from short-circuiting the adjacent contact portions 61*a* in the pitch direction and short-circuiting the adjacent mating contact portions 71*a* in the pitch direction.

Even in the case of the combination of the connecting members 101 and the holding member 51 described above with reference to FIGS. 2 to 4, the connector 401 of the third exemplary embodiment operates in the contact manner described above with reference to FIG. 7B. Therefore, when the structure with the combination of the connecting members 101 and the holding member 51 is employed, it is possible to obtain the same effect as that described above with reference to FIG. 7B.

Figure 8:
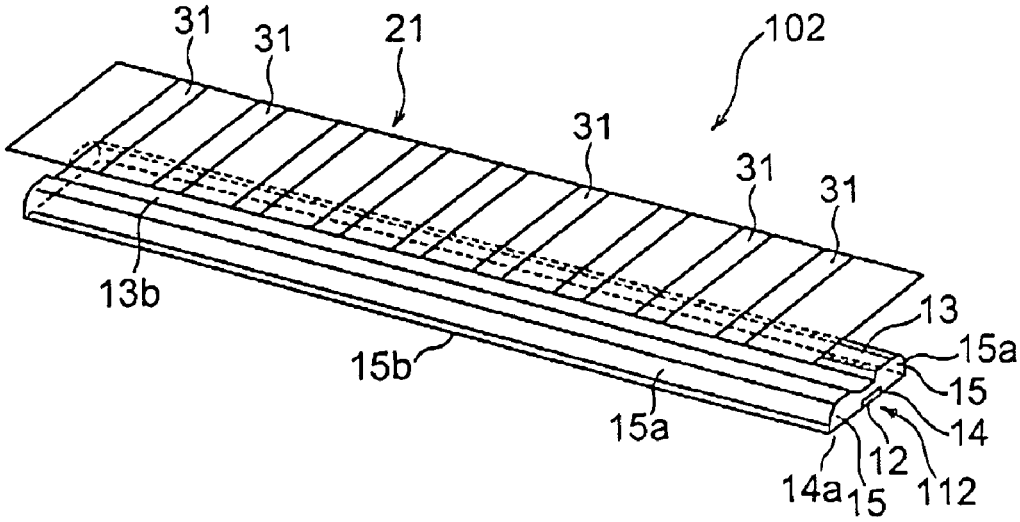
FIG. 8 is a perspective view showing a connecting member, different from the connecting members shown in FIGS. 1 and 2, in a disassembled state as a connecting member for use in an electrical connector according to this invention.

FIG. 8 shows a modification of the connecting member 101 shown in FIGS. 2 to 4. The same reference symbols are assigned to the same portions as those of the connecting member 101 shown in FIGS. 2 to 4, thereby omitting explanation thereof.

Referring to FIG. 8, a connecting member 102 includes an elastic body 112, a reinforcing member 12 for reinforcing the elastic body 112, a film 21 provided on the elastic body 112, and conductors 31 disposed at predetermined positions on the film 21.

The elastic body 112 is formed with an escape groove 13*a* on a holding surface 13 thereof. The escape groove 13*a* is located in the middle of the holding surface 13 in a width direction perpendicular to a longitudinal direction of the elastic body 112 and extends in the longitudinal direction of the elastic body 112. The film 21 is fixedly bonded to the elastic body 112 so as to cover the holding surface 13 including the escape groove 13*a*, curved surfaces 15*a*, and side surfaces 15*b* of the elastic body 112.

Figure 9:
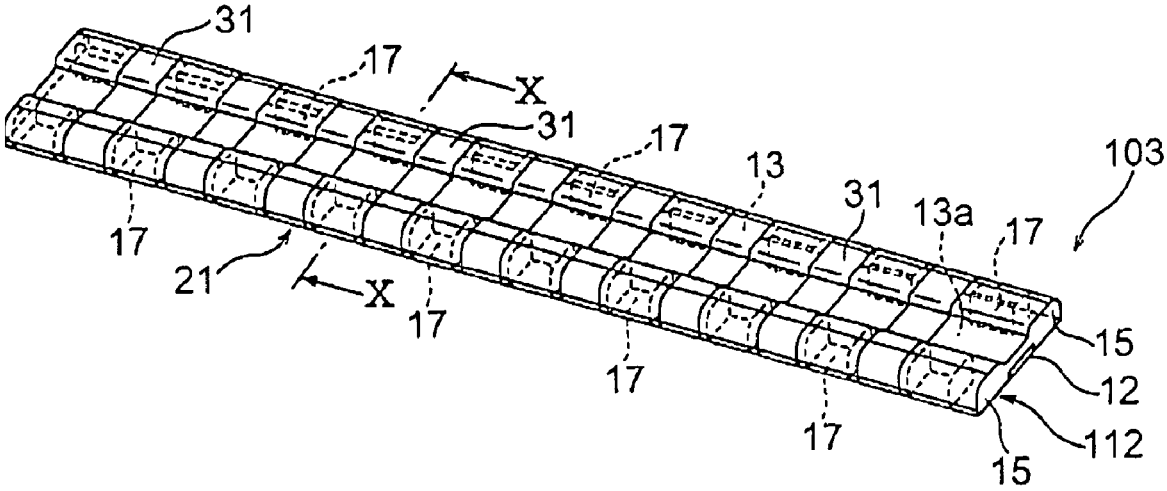
FIG. 9 is a perspective view showing a modification of the connecting member shown in FIG. 8.
Figure 10:
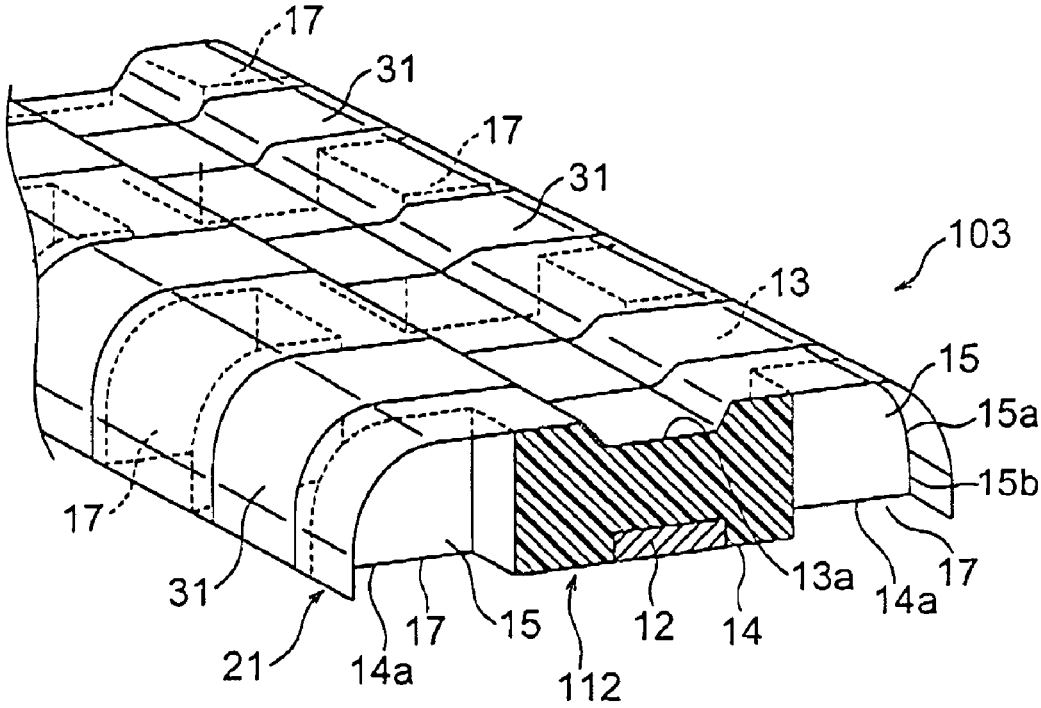
FIG. 10 is a sectional view taken along line X-X of the connecting member shown in FIG. 9.

FIGS. 9 and 10 show a modification of the connecting member 102 described above with reference to FIG. 8. The same reference symbols are assigned to the same portions as those of the connecting member 102 shown in FIG. 8, thereby omitting explanation thereof.

Referring to FIGS. 9 and 10, a connecting member 103 is formed with a plurality of grooves 17 at each of a pair of projecting portions 15 of an elastic body 112. The elastic body 112 is further formed with an escape groove 13*a* between the projecting portions 15. The grooves 17 are formed at the projecting portions 15 except their portions facing conductors 31. The escape groove 13*a* is located between the projecting portions 15.

The grooves 17 are arranged so as to match the pitch of the conductors 31 in the longitudinal direction. The grooves 17 serve as escape portions for the elastic body 112 when it is deformed due to compression in the connecting direction A. Therefore, the grooves 17 serve to improve the deformation capability of the elastic body 112 in a constant load state.

The grooves 17 are formed on the elastic body 112 at the positions that do not overlap the conductors 31 disposed on a film 21 when the film 21 is held on a holding surface 13 of the elastic body 112. Since the projecting portions 15 each have a concavo-convex shape due to the grooves 17, the elastic body 112 achieves high deformation capability. It is possible to easily change the deformation capability of the elastic body 112 by changing the dimensions of each groove 17 in the longitudinal and width directions.

Figure 11:
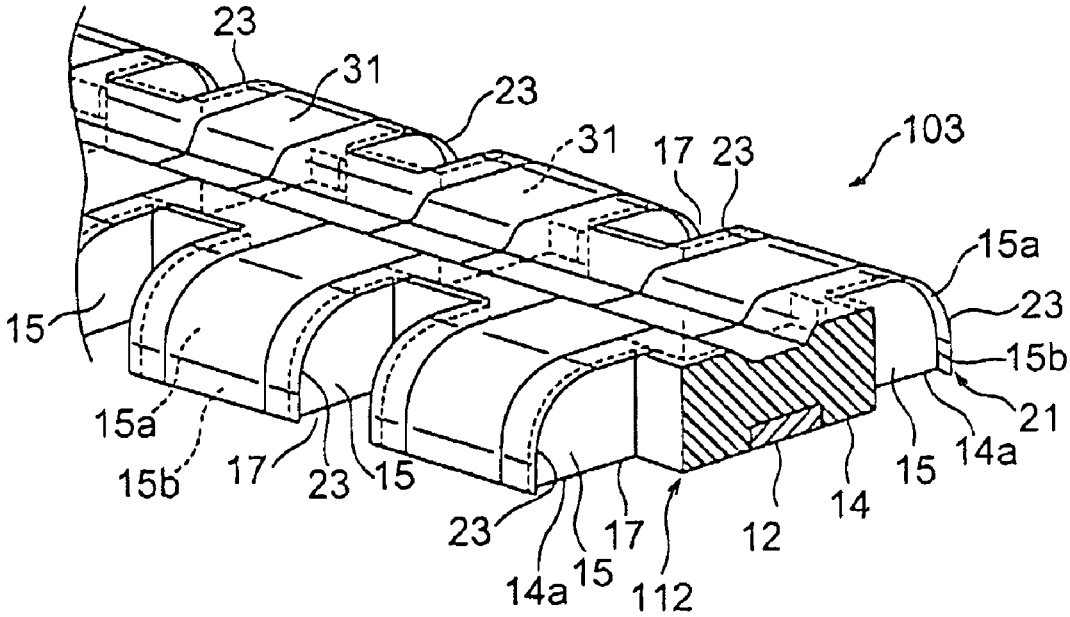
FIG. 11 is a perspective view showing a modification of the connecting member shown in FIG. 9.

FIG. 11 shows a modification of the connecting member 103 described above with reference to FIGS. 9 and 10. In a connecting member 104 shown in FIG. 11, the film 21 described above with reference to FIGS. 9 and 10 is formed with a plurality of cutout portions 23. That is, the cutout portions 23 are formed by removing portions, facing the grooves 17, of the film 21.

By forming the cutout portions 23 in the film 21, it is possible to provide independence in deformation amount of the elastic body 112 between the conductors 31. That is, the cutout portions 23 effectively work on distortion or warping of the connection object 61 or the mating connection object 71 shown in FIG. 5A, or on minute differences in height of the conductors 31.

Therefore, the cutout portions 23 can achieve the connection stability for the conductors 31.

Specifically, the number of the contact portions 61*a* of the connection object 61 and the number of the mating contact portions 71*a* of the mating connection object 71 shown in FIG. 5A are each set to 20 (contact portions) ×4 (rows). In this event, when connecting the connection object 61 and the mating connection object 71 to each other, a technique may be used to divide a connecting member with 100 conductors into five connecting members each having 20 conductors and the four connecting members are inserted and fixed in accommodating portions 52 of a holding member 51 shown in FIG. 12.

Fourth Exemplary Embodiment

Figure 12:
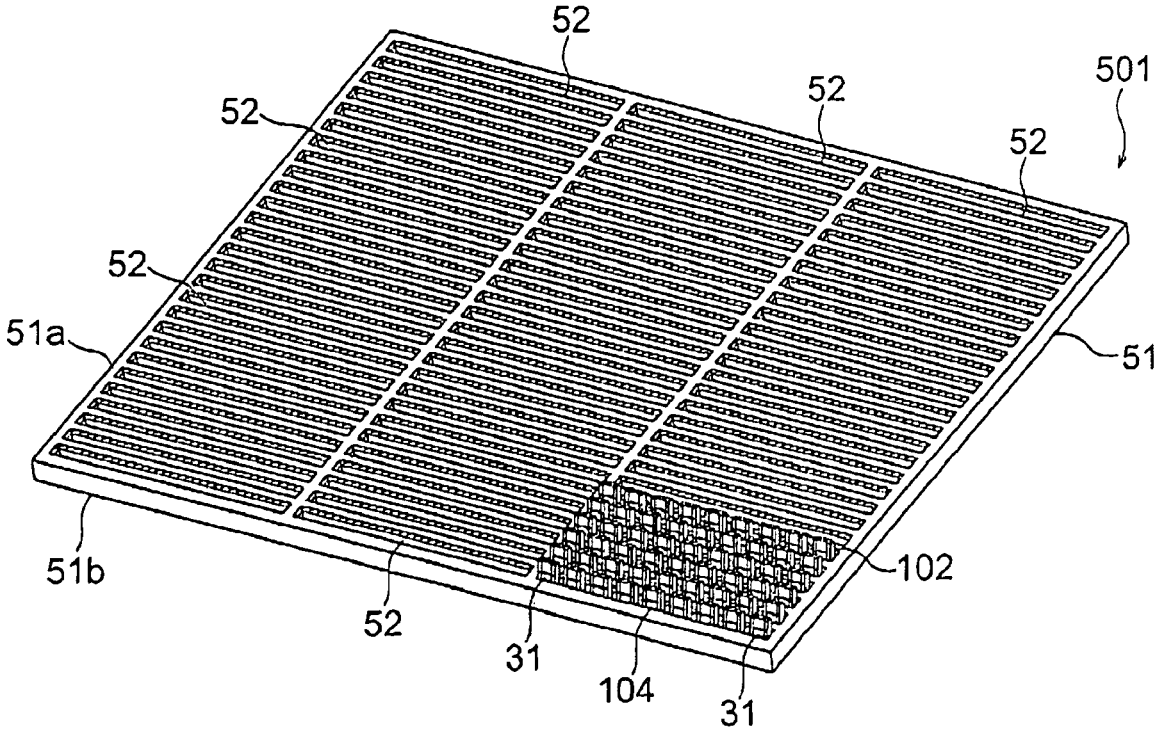
FIG. 12 is a perspective view of an electrical connector having the connecting members shown in FIG. 11.

FIG. 12 shows a connector 501 according to a fourth exemplary embodiment of this invention, wherein the connector 501 includes the connecting members 102 shown in FIG. 8 and a holding member 51 in which the connecting members 102 are arranged in a plurality of rows. Since accommodating portions 52 of the holding member 51 each have the same structure as that of the holding member 51 shown in FIG. 4, the following description will be given using the same reference symbols.

In the holding member 51, the accommodating portions 52 are formed at a predetermined interval from each other. The connecting members 102 shown in FIG. 8 are inserted into the accommodating portions 52, respectively, so as to be held by the holding member 51.

Although FIG. 12 shows the state of the connector 501 where the connecting members 102 are held in part of the accommodating portions 52, the connecting members 102 can be held in all the accommodating portions 52.

Further, in the connector 501 shown in FIG. 12, the connecting members 103 shown in FIG. 9 and 10 or the connecting members 104 shown in FIGS. 11 may be held in the accommodating portions 52, thereby forming the connector 501.

Figure 13B:
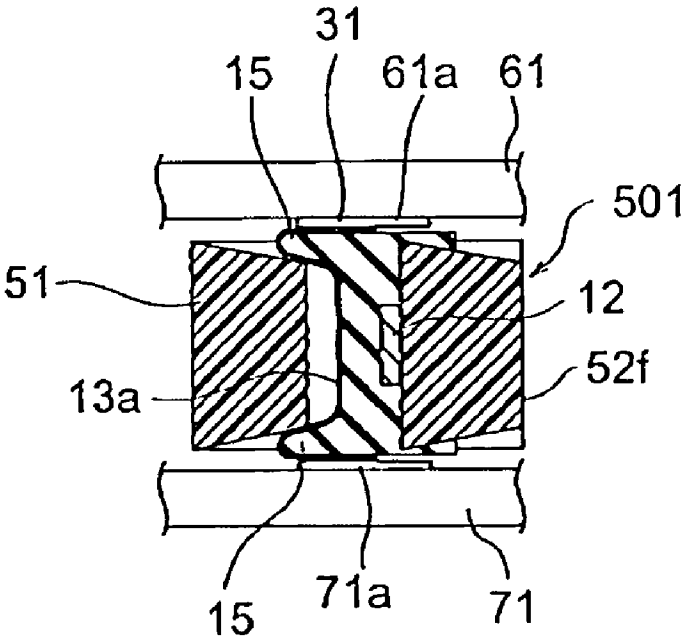
Figure 13A:
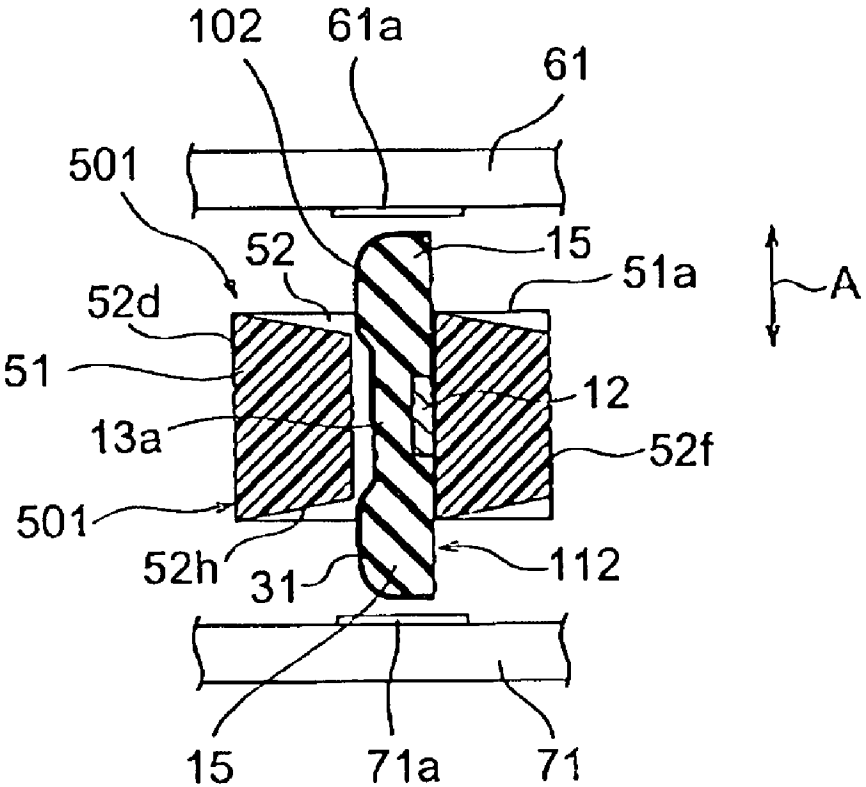

FIG. 13A shows a section of part of the connector 501. Since the accommodating portion 52 of the holding member 51 shown in FIG. 13A is the same in structure as the accommodating portion 52 of the holding member 51 described above with reference to FIGS. 4 and 5A, the same reference symbols are assigned to the same portions, thereby omitting part of the description.

Although a connecting member 102 shown in FIG. 13A is the same in structure as the connecting member 102 described above with reference to FIG. 8, an illustration of the film 21 of the connecting member 102 shown in FIG. 8 is omitted in FIG. 13A.

Each accommodating portion 52 includes a first wall 52*d* facing a base surface 14 of an elastic body 112, a second wall 52*f* facing a holding surface 13 of the elastic body 112, and a pair of restraining portions 52*h*.

The base surface 14 and the holding surface 13 of the elastic body 112 are inserted and held between the first wall 52*d* and the second wall 52*f* so as to face the first wall 52*d* and the second wall 52*f*, respectively. In this state, one of a pair of projecting portions 15 is located above an upper surface 51*a* of the holding member 51, while, the other projecting portion 15 is located below a lower surface 51*b* of the holding member 51.

The holding surface 13 of the elastic body 112 is formed with an escape groove 13*a*. That is, the elastic body 112 is formed with the escape groove 13*a* that is located in the middle of the holding surface 13 in a width direction perpendicular to a longitudinal direction of the elastic body 112 and extends in the longitudinal direction of the elastic body 112.

By cutting the connecting member 102 to a predetermined dimension in its longitudinal direction so as to match the dimension of the accommodating portion 52 in its longitudinal direction, the connecting member 102 can be held in the accommodating portion 52.

Those portions, disposed at the projecting portion 15 on one side, of the conductors 31 are brought into contact with corresponding contact portions 61*a* of a connection object 61. On other hand, those portions, disposed at the projecting portion 15 on the other side, of the conductors 31 are brought into contact with corresponding mating contact portions 71*a* of a mating connection object 71. That is, by relatively moving the connection object 61 and the mating connection object 71 so as to shorten the distance therebetween, the connection object 61 and the mating connection object 71 are brought into contact with the conductors 31 as shown in FIG. 13B.

As shown in FIG. 13B, the connection object 61 and the mating connection object 71 are relatively moved so as to shorten the distance therebetween. In this event, the connecting members 102 are compressed in the connecting direction A by the connection object 61 and the mating connection object 71. At the time of the compression, the contact portions 61*a* and the mating contact portions 71*a* are brought into contact with the conductors 31. Simultaneously, portions of each pair of projecting portions 15 are deformed in predetermined directions due to the compression so as to move into spaces defined on the restraining portions 52*h*. That is, the portions of each pair of projecting portions 15 move into the spaces on the restraining portions 52*h* of the accommodating portion 52 due to the compression.

Since the elastic bodies 112 are each formed with the escape groove 13*a*, smooth compression is enabled when the elastic bodies 112 are compressed in the connecting direction A. This further facilitates the deformation of the elastic bodies 112 in the predetermined directions by the presence of the restraining portions 52*h*.

The deformed portions of the projecting portions 15 move in the predetermined directions into the spaces on the restraining portions 52*h* after the connection object 61 and the mating connection object 71 are connected together by the connecting members 102. Therefore, the conductors 31 of the adjacent connecting members 102 are prevented from being short-circuited with each other.

Further, at the time of the connection, even if the pitch of the contact portions 61*a* and the pitch of the mating contact portions 71*a* are narrow, the portions of each pair of projecting portions 15 move into the spaces on the restraining portions 52*h* due to the compression. Therefore, the conductors 31 of each connecting member 102 can be prevented from short-circuiting the adjacent contact portions 61*a* in the pitch direction and short-circuiting the adjacent mating contact portions 71*a* in the pitch direction.

In the connector 501 of the fourth exemplary embodiment, even if the grooves 17 or the grooves 17 and the cutout portions 23 are added like the connecting member 103 or 104 shown in FIGS. 9 and 10 or FIG. 11, the connection state shown in FIG. 13B is achieved.

Therefore, when the structure of the connecting member 103 or 104 is employed, it is possible to obtain the same effect as that described above with reference to FIG. 13B.

Accordingly, the connecting member 103 or 104 described above with reference to FIGS. 9 and 10 or FIG. 11 can be used as one component of the connector 501 described above with reference to FIG. 13A as the fourth exemplary embodiment.

Fifth Exemplary Embodiment

Figure 14B:
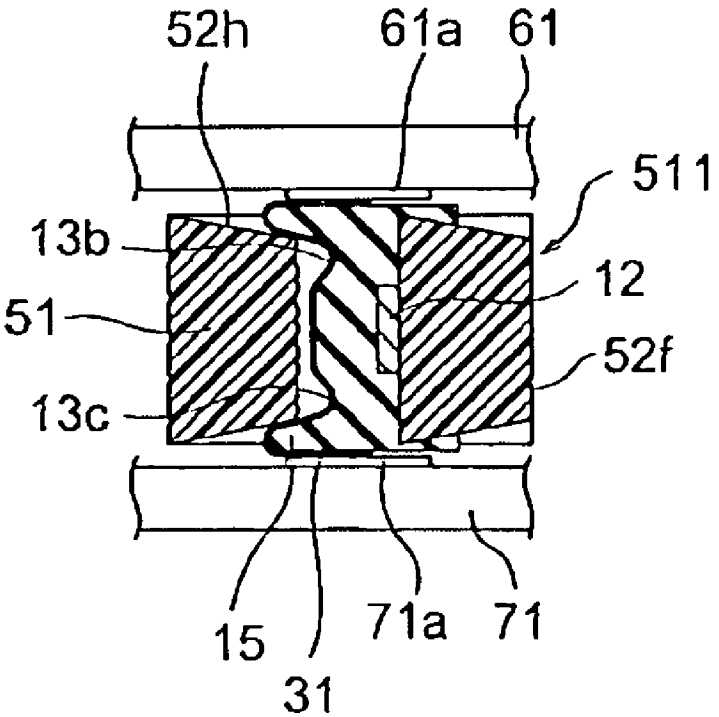
Figure 14A:
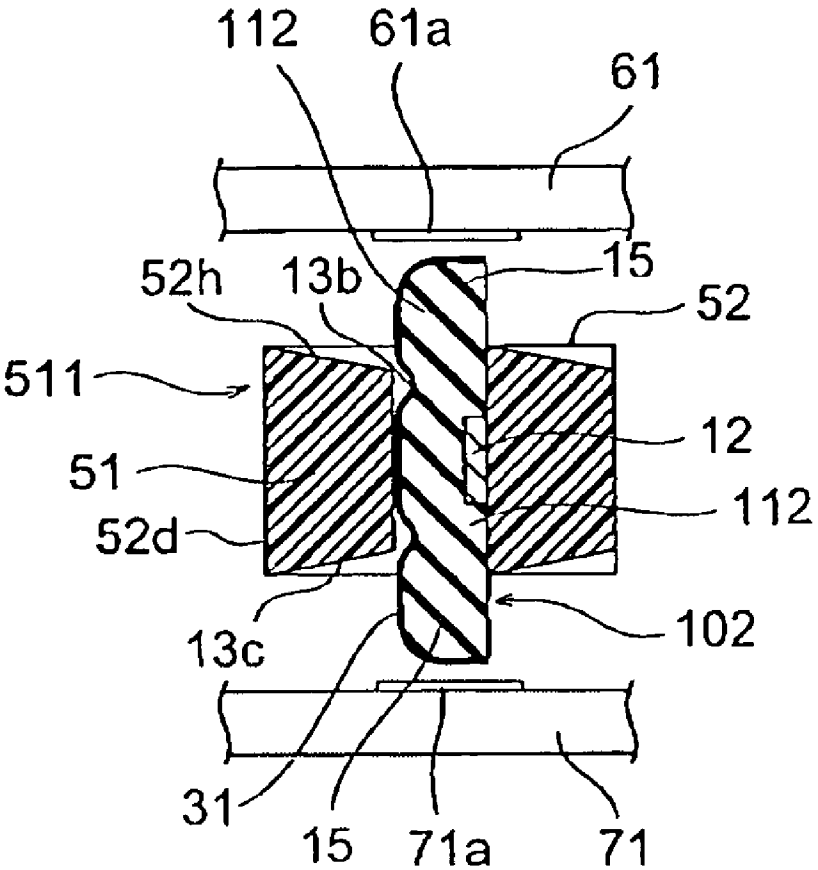

FIG. 14A shows a connector 511 according to a fifth exemplary embodiment of this invention. The connector 511 differs from the connector 501 in the fourth exemplary embodiment of FIG. 13A only in the connecting members 102. Therefore, the same reference symbols are assigned to the same portions as those of the connector 501 shown in FIG. 13A, thereby omitting explanation thereof.

Referring to FIG. 14A, an elastic body 112 of each connecting member 102 is formed with two escape grooves 13*b* and 13*c* on a holding surface 13 thereof. The escape grooves 13*b* and 13*c* are located in the middle of the holding surface 13 in a width direction perpendicular to a longitudinal direction of the elastic body 112 and each extend in the longitudinal direction of the elastic body 112. The escape grooves 13*b* and 13*c* are located at a predetermined distance from each other in the connecting direction A. The film 21 described above with reference to FIG. 8 is held on the elastic body 112 so as to cover the holding surface 13 including the escape grooves 13*b* and 13*c*, curved surfaces 15*a*, and side surfaces 15*b* of the elastic body 112.

As shown in FIG. 14B, a connection object 61 and a mating connection object 71 are relatively moved so as to shorten the distance therebetween. In this event, the connecting members 102 are compressed in the connecting direction A by the connection object 61 and the mating connection object 71. At the time of the compression, contact portions 61*a* of the connection object 61 and mating contact portions 71*a* of the mating connection object 71 are brought into contact with the conductors 31. Simultaneously, portions of each pair of projecting portions 15 are deformed in predetermined directions due to the compression so as to move into spaces defined on restraining portions 52*h* of an accommodating portion 52.

Since the elastic bodies 112 are each formed with the escape grooves 13*b* and 13*c* facing a second wall 52*f* of the accommodating portion 52 with a gap therebetween, smooth compression is enabled when the elastic bodies 112 are compressed in the connecting direction A. This further facilitates the deformation of the connecting members 102 in the predetermined directions by the presence of the restraining portions 52*h*.

Since the deformed portions of the projecting portions 15 move in the predetermined directions into the spaces on the restraining portions 52*h* after the connection object 61 and the mating connection object 71 are connected together by the connecting members 102, the conductors 31 of the adjacent connecting members 102 are prevented from being short-circuited with each other.

Further, at the time of the connection, even if the pitch of the contact portions 61*a* and the pitch of the mating contact portions 71*a* are narrow, the portions of each pair of projecting portions 15 move into the spaces on the restraining portions 52*h* due to the compression. Therefore, the conductors 31 of each connecting member 102 can be prevented from short-circuiting the adjacent contact portions 61*a* in the pitch direction and short-circuiting the adjacent mating contact portions 71*a* in the pitch direction.

In the connector 511 of the fifth exemplary embodiment, even if the grooves 17 or the grooves 17 and the cutout portions 23 are added like the connecting member 103 or 104 shown in FIGS. 9 and 10 or FIG. 11, the connection state shown in FIG. 14B is achieved.

Therefore, when the structure of the connecting member 103 or 104 is employed, it is possible to obtain the same effect as that described above with reference to FIG. 14B.

Accordingly, the connecting member 103 or 104 described above with reference to FIGS. 9 and 10 or FIG. 11 can be used as one component of the connector 511 described above with reference to FIG. 14A as the fourth exemplary embodiment.

Sixth Exemplary Embodiment

Figure 15B:
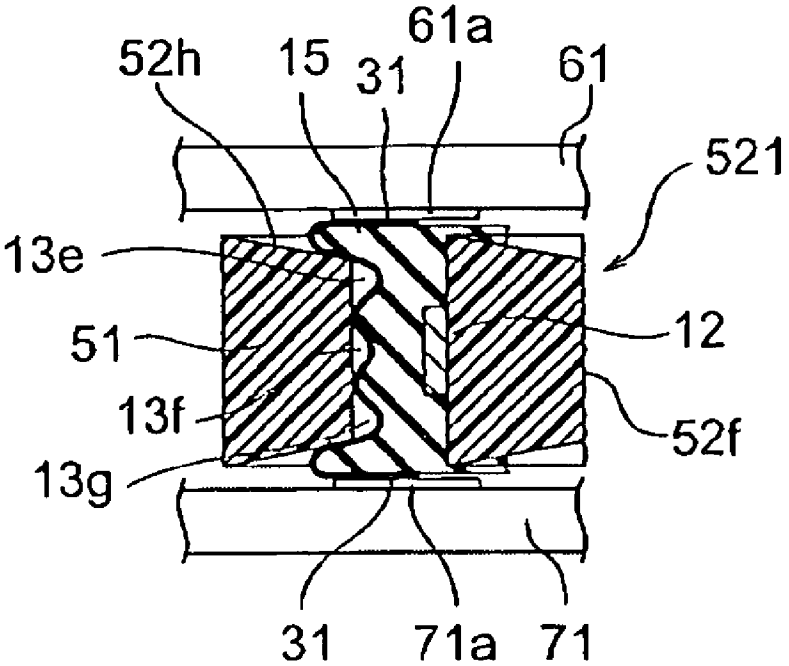
Figure 15A:
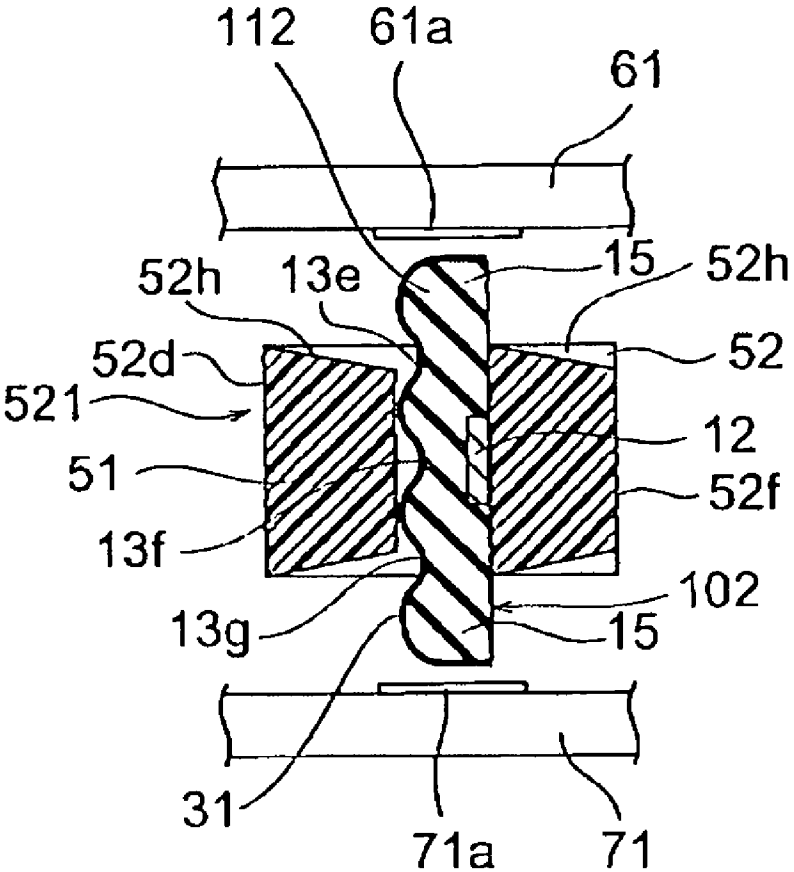

FIG. 15A shows a connector 521 according to a sixth exemplary embodiment of this invention. The connector 521 differs from the connector 501 in the fourth exemplary embodiment of FIG. 13A only in the connecting members 102. Therefore, the same reference symbols are assigned to the same portions as those of the connector 501 shown in FIG. 13A, thereby omitting explanation thereof.

Referring to FIG. 15A, an elastic body 112 of each connecting member 102 is formed with three escape grooves 13*e*, 13*f*, and 13*g* on a holding surface 13 thereof. The escape grooves 13*e*, 13*f*, and 13*g* are located in the middle of the holding surface 13 in a width direction perpendicular to a longitudinal direction of the elastic body 112 and each extend in the longitudinal direction of the elastic body 112. The escape grooves 13*e*, 13*f*, and 13*g* are located at a predetermined distance from each other in the connecting direction A. The film 21 described above with reference to FIG. 8 is fixed on the elastic body 112 so as to cover the holding surface 13 including the escape grooves 13*e*, 13*f*, and 13*g*, curved surfaces 15*a*, and side surfaces 15*b* of the elastic body 112.

As shown in FIG. 15B, a connection object 61 and a mating connection object 71 are relatively moved so as to shorten the distance therebetween. In this event, the connecting members 102 are compressed in the connecting direction A by the connection object 61 and the mating connection object 71. At the time of the compression, contact portions 61*a* of the connection object 61 and mating contact portions 71*a* of the mating connection object 71 are brought into contact with the conductors 31. Simultaneously, portions of each pair of projecting portions 15 are deformed in predetermined directions due to the compression so as to move into spaces defined on restraining portions 52*h* of an accommodating portion 52. Accordingly, the portions of each pair of projecting portions 15 move into the spaces on the restraining portions 52*h* of the accommodating portion 52 due to the compression.

Since the elastic bodies 112 are each formed with the escape grooves 13*e*, 13*f*, and 13*g* facing a second wall 52*f* of the accommodating portion 52 with a gap therebetween, smooth compression is enabled when the elastic bodies 112 are compressed in the connecting direction A. This further facilitates the deformation of the connecting members 102 in the predetermined directions by the presence of the restraining portions 52*h*.

Since the deformed portions of the projecting portions 15 move in the predetermined directions into the spaces on the restraining portions 52*h* after the connection object 61 and the mating connection object 71 are connected together by the connecting members 102, the conductors 31 of the adjacent connecting members 102 are prevented from being short-circuited with each other.

Further, at the time of the connection, even if the pitch of the contact portions 61*a* and the pitch of the mating contact portions 71*a* are narrow, the portions of each pair of projecting portions 15 move into the spaces on the restraining portions 52*h* due to the compression. Therefore, the conductors 31 of each connecting member 102 can be prevented from short-circuiting the adjacent contact portions 61*a* in the pitch direction and short-circuiting the adjacent mating contact portions 71*a* in the pitch direction.

In the connector 521 of the sixth exemplary embodiment, even if the grooves 17 or the grooves 17 and the cutout portions 23 are added like the connecting member 103 or 104 shown in FIGS. 9 and 10 or FIG. 11, the connection state shown in FIG. 15B is achieved.

Therefore, when the structure of the connecting member 103 or 104 is employed, it is possible to obtain the same effect as that described above with reference to FIG. 15B.

Accordingly, the connecting member 103 or 104 described above with reference to FIGS. 9 and 10 or FIG. 11 can be used as one component of the connector 521 described above with reference to FIG. 15A as the sixth exemplary embodiment.

Seventh Exemplary Embodiment

Figure 16B:
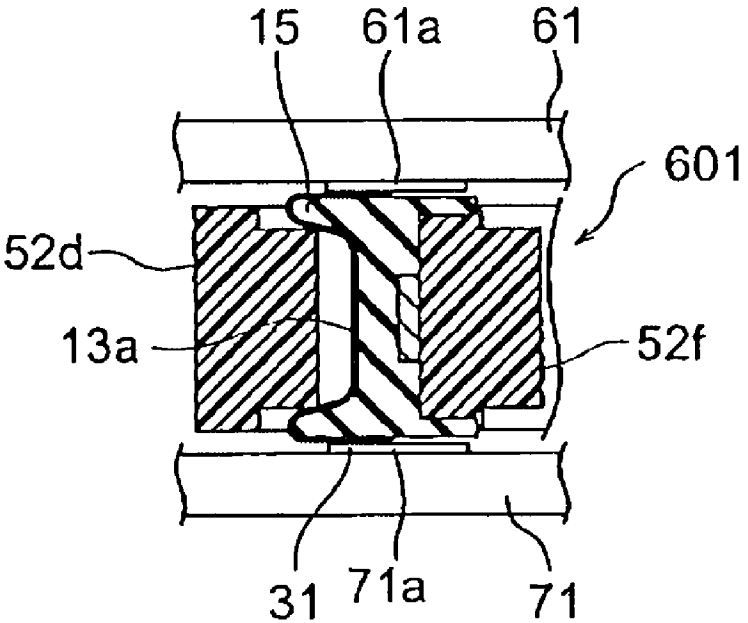
Figure 16A:
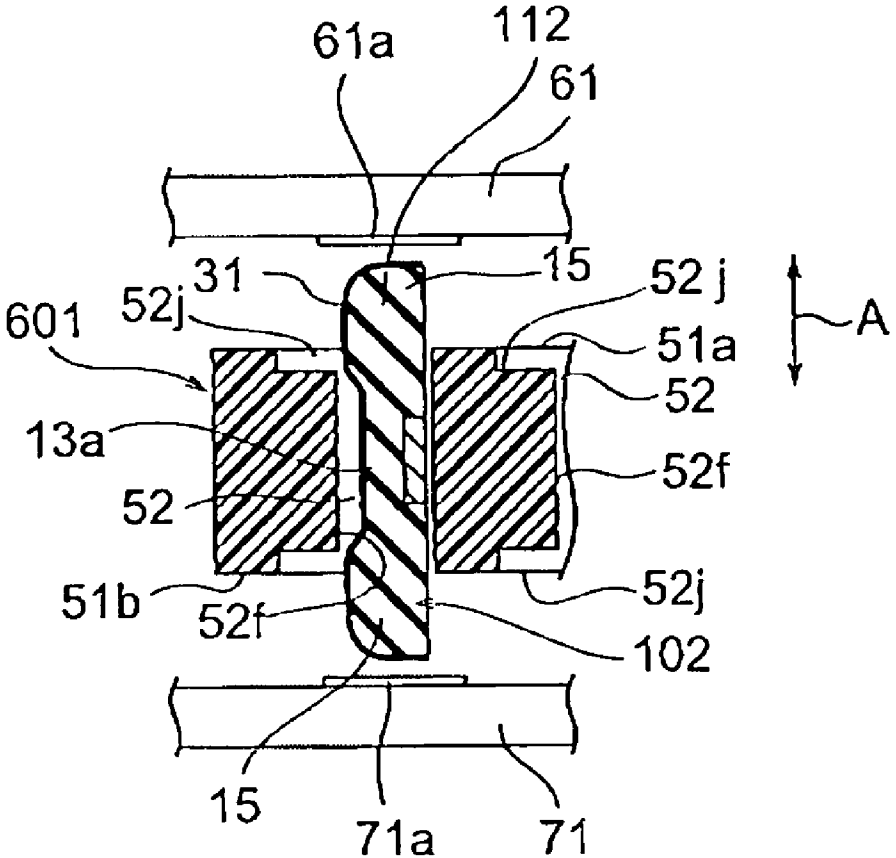

FIG. 16A shows a connector 601 according to a seventh exemplary embodiment of this invention. The connector 601 differs from the connector 301 in the second exemplary embodiment of FIG. 6A only in the connecting members 11. Therefore, the same reference symbols are assigned to the same portions as those of the connector 301 shown in FIG. 6A, thereby omitting explanation thereof.

FIG. 16A shows a section of part of the connector 601. An accommodating portion 52 of a holding member 51 shown in FIG. 16A is the same in structure as the accommodating portion 52 of the holding member 51 described above with reference to FIG. 4. Therefore, the same reference symbols are assigned to the same portions as those of the accommodating portion 52 of the holding member 51 described above with reference to FIG. 4, thereby omitting part of the description. Further, a connecting member 102 shown in FIG. 16A is the same in structure as the connecting member 102 shown in FIG. 13A.

Referring to FIG. 16A, an elastic body 112 of each connecting member 102 is formed with an escape groove 13*a* on a holding surface 13 thereof. The escape groove 13*a* is located in the middle of the holding surface 13 in a width direction perpendicular to a longitudinal direction of the elastic body 112 and extends in the longitudinal direction of the elastic body 112. The film 21 shown in FIG. 8 is held on the elastic body 112 so as to cover the holding surface 13 including the escape groove 13*a*, curved surfaces 15*a*, and side surfaces 15*b* of the elastic body 112.

As shown in FIG. 16B, a connection object 61 and a mating connection object 71 are relatively moved so as to shorten the distance therebetween. In this event, the connecting members 102 are compressed in the connecting direction A by the connection object 61 and the mating connection object 71. At the time of the compression, contact portions 61*a* of the connection object 61 and mating contact portions 71*a* of the mating connection object 71 are brought into contact with the conductors 31. Simultaneously, portions of each pair of projecting portions 15 are deformed in predetermined directions due to the compression so as to move into spaces defined on restraining portions 52*j* of the accommodating portion 52.

Accordingly, the portions of each pair of projecting portions 15 move into the spaces on the restraining portions 52*j* of the accommodating portion 52 due to the compression. Since the elastic bodies 112 are each formed with the escape groove 13*a*, smooth compression is enabled when the elastic bodies 112 are compressed in the connecting direction A. This further facilitates the deformation of the connecting members 102 in the predetermined directions into the spaces on the restraining portions 52*j*.

The deformed portions of the projecting portions 15 move in the predetermined directions into the spaces on the restraining portions 52*j* after the connection object 61 and the mating connection object 71 are connected together by the connecting members 102. Therefore, the conductors 31 of the adjacent connecting members 102 are prevented from being short-circuited with each other.

Further, at the time of the connection, even if the pitch of the contact portions 61*a* and the pitch of the mating contact portions 71*a* are narrow, the portions of each pair of projecting portions 15 move into the spaces on the restraining portions 52*j* due to the compression. Therefore, the conductors 31 of each connecting member 102 can be prevented from short-circuiting the adjacent contact portions 61*a* in the pitch direction and short-circuiting the adjacent mating contact portions 71*a* in the pitch direction.

In the connector 601 of the seventh exemplary embodiment, even if the grooves 17 or the grooves 17 and the cutout portions 23 are added like the connecting member 103 or 104 shown in FIGS. 9 and 10 or FIG. 11, the connection state shown in FIG. 16B is achieved.

Therefore, when the structure of the connecting member 103 or 104 is employed, it is possible to obtain the same effect as that described above with reference to FIG. 16B.

Accordingly, the connecting member 103 or 104 described above with reference to FIGS. 9 and 10 or FIG. 11 can be used as one component of the connector 601 described above with reference to FIG. 16A as the seventh exemplary embodiment.

Eighth Exemplary Embodiment

Figure 17B:
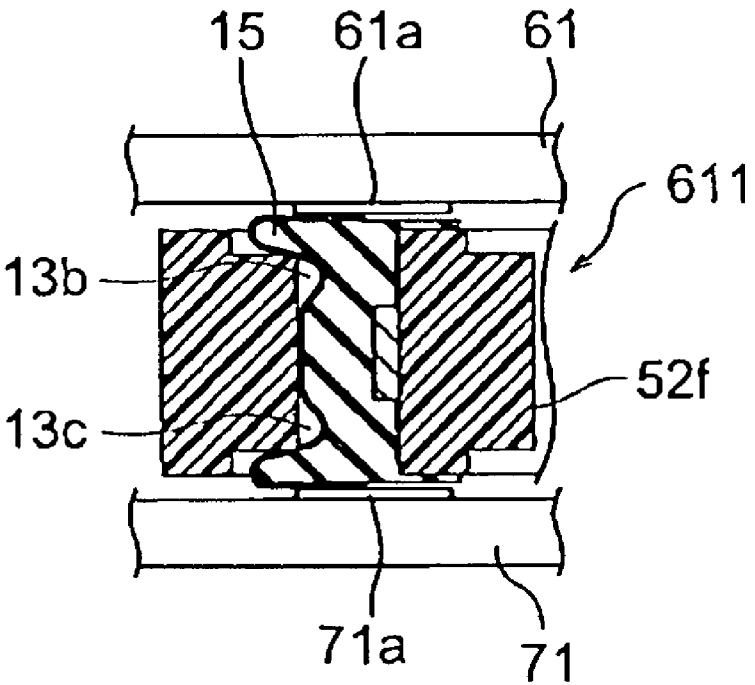
Figure 17A:
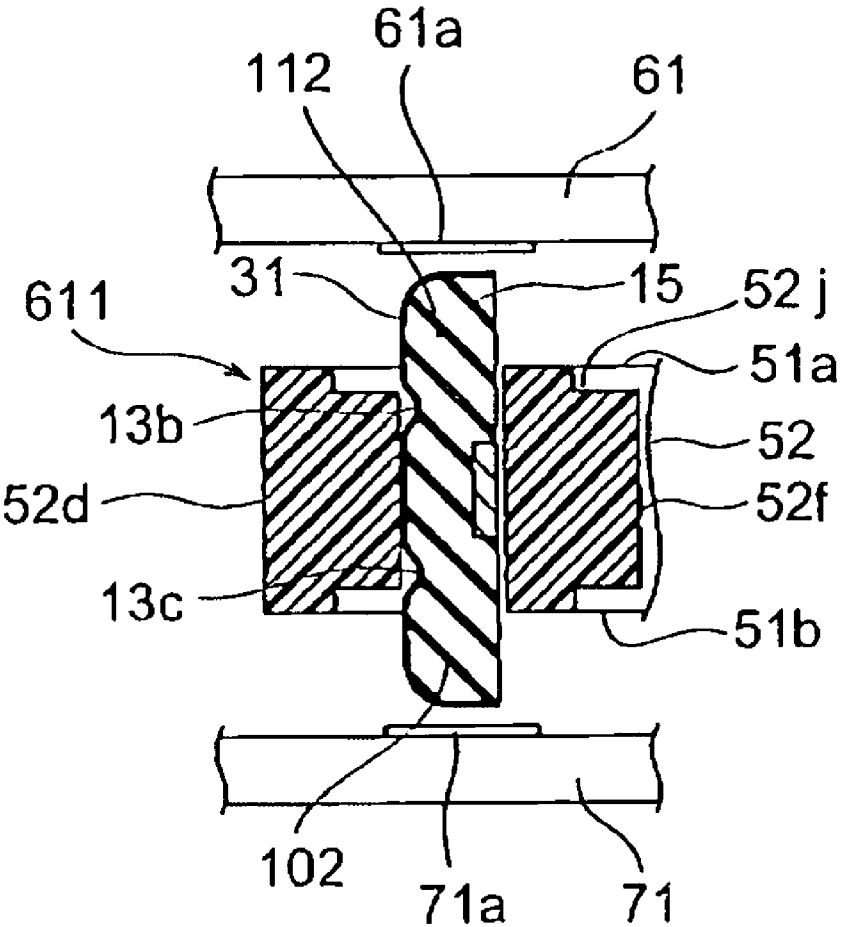

FIG. 17A shows a connector 611 according to an eighth exemplary embodiment of this invention. The connector 611 differs from the connector 601 in the seventh exemplary embodiment of FIG. 16A only in the connecting members 102. Therefore, the same reference symbols are assigned to the same portions as those of the connector 601 shown in FIG. 16A, thereby omitting explanation thereof.

Referring to FIG. 17A, an elastic body 112 of each connecting member 102 is formed with two escape grooves 13*b* and 13*c* on a holding surface 13 thereof. The escape grooves 13*b* and 13*c* are located in the middle of the holding surface 13 in a width direction perpendicular to a longitudinal direction of the elastic body 112 and each extend in the longitudinal direction of the elastic body 112. The escape grooves 13*b* and 13*c* are located at a predetermined distance from each other in the connecting direction A. The film 21 described above with reference to FIG. 8 is held on the elastic body 112 so as to cover the holding surface 13 including the escape grooves 13*b* and 13*c*, curved surfaces 15*a*, and side surfaces 15*b* of the elastic body 112.

As shown in FIG. 17B, a connection object 61 and a mating connection object 71 are relatively moved so as to shorten the distance therebetween. In this event, the connecting members 102 are compressed in the connecting direction A by the connection object 61 and the mating connection object 71. At the time of the compression, contact portions 61*a* of the connection object 61 and mating contact portions 71*a* of the mating connection object 71 are brought into contact with the conductors 31. Simultaneously, portions of each pair of projecting portions 15 are deformed in predetermined directions due to the compression so as to move into spaces defined on restraining portions 52*j* of an accommodating portion 52.

Accordingly, the portions of each pair of projecting portions 15 move into the spaces on the restraining portions 52*j* of the accommodating portion 52 due to the compression.

Since the elastic bodies 112 are each formed with the escape grooves 13*b* and 13*c* facing a second wall 52*f* of the accommodating portion 52 with a gap therebetween, smooth compression is enabled when the elastic bodies 112 are compressed in the connecting direction A. This further facilitates the deformation of the connecting members 102 in the predetermined directions by the presence of the restraining portions 52*j*.

Since the deformed portions of the projecting portions 15 move in the predetermined directions into the spaces on the restraining portions 52*j* after the connection object 61 and the mating connection object 71 are connected together by the connecting members 102, the conductors 31 of the adjacent connecting members 102 are prevented from being short-circuited with each other.

Further, at the time of the connection, even if the pitch of the contact portions 61*a* and the pitch of the mating contact portions 71*a* are narrow, the portions of each pair of projecting portions 15 move into the spaces on the restraining portions 52*j* due to the compression. Therefore, the conductors 31 of each connecting member 102 can be prevented from short-circuiting the adjacent contact portions 61*a* in the pitch direction and short-circuiting the adjacent mating contact portions 71*a* in the pitch direction.

In the connector 611 of the eighth exemplary embodiment, even if the grooves 17 or the grooves 17 and the cutout portions 23 are added like the connecting member 103 or 104 shown in FIGS. 9 and 10 or FIG. 11, the connection state shown in FIG. 17B is achieved.

Therefore, when the structure of the connecting member 103 or 104 is employed, it is possible to obtain the same effect as that described above with reference to FIG. 17B.

Accordingly, the connecting member 103 or 104 described above with reference to FIGS. 9 and 10 or FIG. 11 can be used as one component of the connector 611 described above with reference to FIG. 17A as the eighth exemplary embodiment.

Ninth Exemplary Embodiment

Figure 18B:
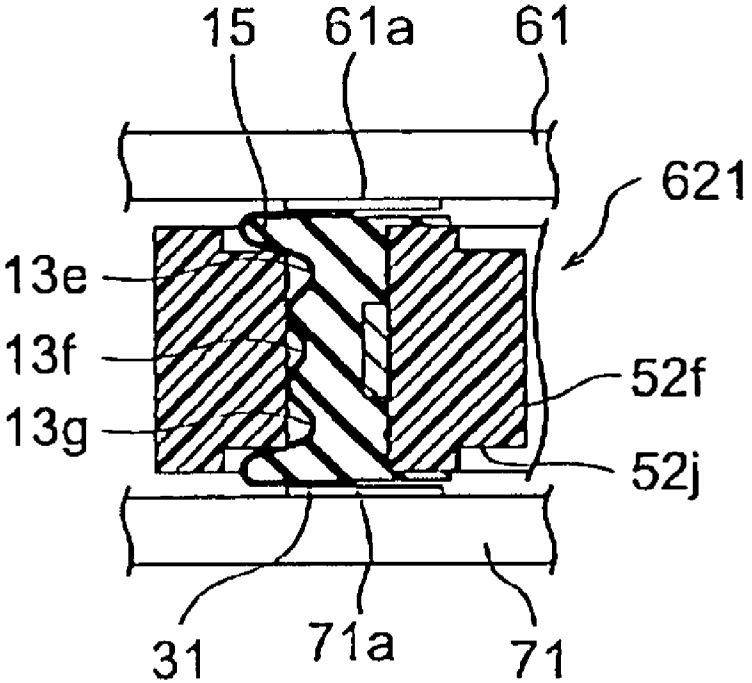
Figure 18A:
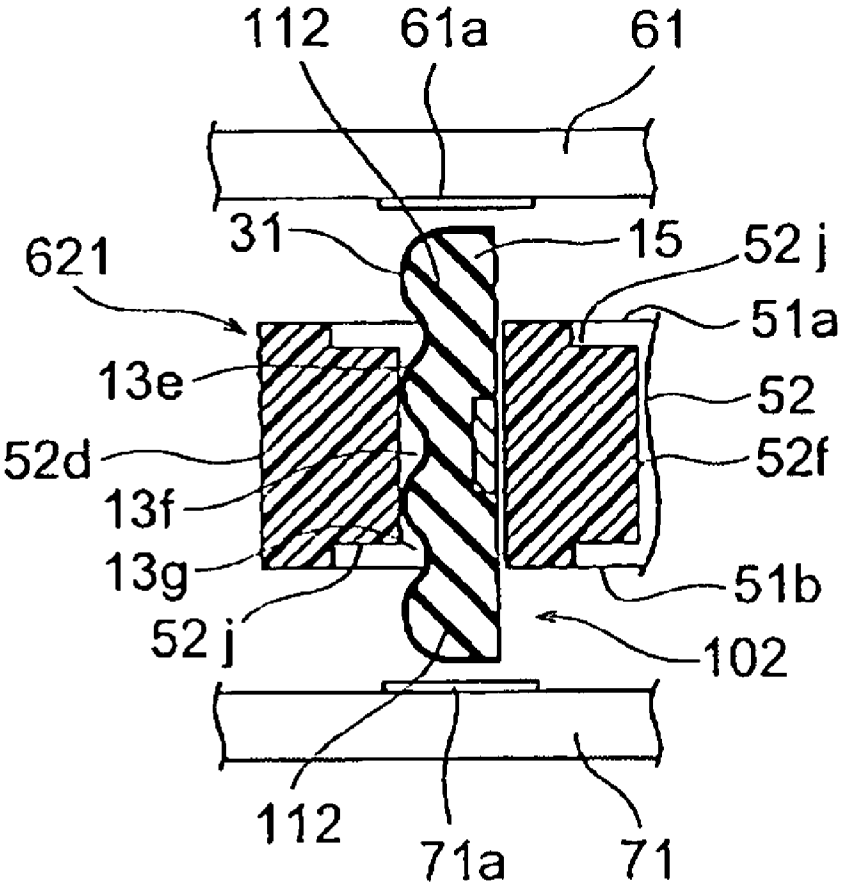

FIG. 18A shows a connector 621 according to a ninth exemplary embodiment of this invention. The connector 621 differs from the connector 601 in the seventh exemplary embodiment of FIG. 16A only in the connecting members 102. Therefore, the same reference symbols are assigned to the same portions as those of the connector 601 shown in FIG. 16A, thereby omitting explanation thereof.

Referring to FIG. 18A, an elastic body 112 of each connecting member 102 is formed with three escape grooves 13*e*, 13*f*, and 13*g* on a holding surface 13 thereof. The escape grooves 13*e*, 13*f*, and 13*g* are located in the middle of the holding surface 13 in a width direction perpendicular to a longitudinal direction of the elastic body 112 and each extend in the longitudinal direction of the elastic body 112. The escape grooves 13*e*, 13*f*, and 13*g* are located at a predetermined distance from each other in the connecting direction A. The film 21 described above with reference to FIG. 8 is held on the elastic body 112 so as to cover the holding surface 13 including the escape grooves 13*e*, 13*f*, and 13*g*, curved surfaces 15*a*, and side surfaces 15*b* of the elastic body 112.

As shown in FIG. 18B, a connection object 61 and a mating connection object 71 are relatively moved so as to shorten the distance therebetween. In this event, the connecting members 102 are compressed in the connecting direction A by the connection object 61 and the mating connection object 71. At the time of the compression, contact portions 61*a* of the connection object 61 and mating contact portions 71*a* of the mating connection object 71 are brought into contact with the conductors 31. Simultaneously, portions of each pair of projecting portions 15 are deformed in predetermined directions due to the compression so as to move into spaces defined on restraining portions 52*j* of an accommodating portion 52.

Accordingly, the portions of each pair of projecting portions 15 move into the spaces on the restraining portions 52*j* of the accommodating portion 52 due to the compression.

Since the elastic bodies 112 are each formed with the escape grooves 13*e*, 13*f*, and 13*g* facing a second wall 52*f* of the accommodating portion 52 with a gap therebetween, smooth compression is enabled when the elastic bodies 112 are compressed in the connecting direction A. This further facilitates the deformation of the connecting members 102 in the predetermined directions by the presence of the restraining portions 52*j*.

Since the deformed portions of the projecting portions 15 move in the predetermined directions into the spaces on the restraining portions 52*j* after the connection object 61 and the mating connection object 71 are connected together by the connecting members 102, the conductors 31 of the adjacent connecting members 102 are prevented from being short-circuited with each other.

Further, at the time of the connection, even if the pitch of the contact portions 61*a* and the pitch of the mating contact portions 71*a* are narrow, the portions of each pair of projecting portions 15 move into the spaces on the restraining portions 52*j* due to the compression. Therefore, the conductors 31 of each connecting member 102 can be prevented from short-circuiting the adjacent contact portions 61*a* in the pitch direction and short-circuiting the adjacent mating contact portions 71*a* in the pitch direction.

In the connector 621 of the ninth exemplary embodiment, even if the grooves 17 or the grooves 17 and the cutout portions 23 are added like the connecting member 103 or 104 shown in FIGS. 9 and 10 or FIG. 11, the connection state shown in FIG. 18B is achieved.

Therefore, when the structure of the connecting member 103 or 104 is employed, it is possible to obtain the same effect as that described above with reference to FIG. 18B.

Accordingly, the connecting member 103 or 104 described above with reference to FIGS. 9 and 10 or FIG. 11 can be used as one component of the connector 621 described above with reference to FIG. 18A as the ninth exemplary embodiment.

Tenth Exemplary Embodiment

Figure 19B:
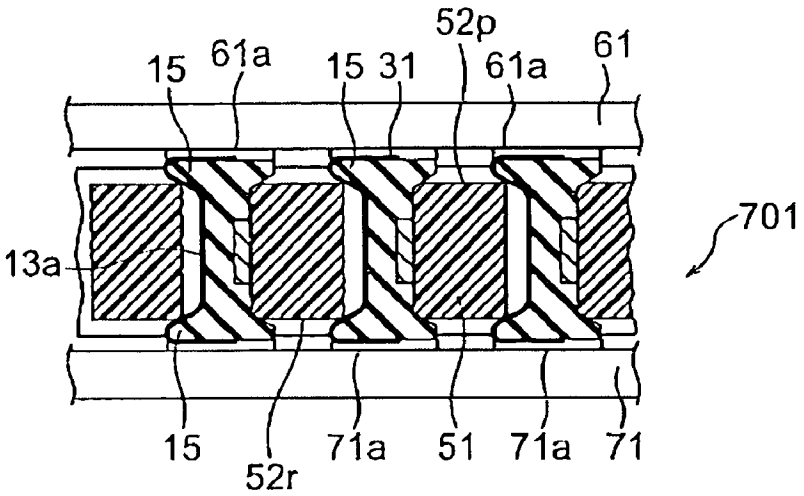
Figure 19A:
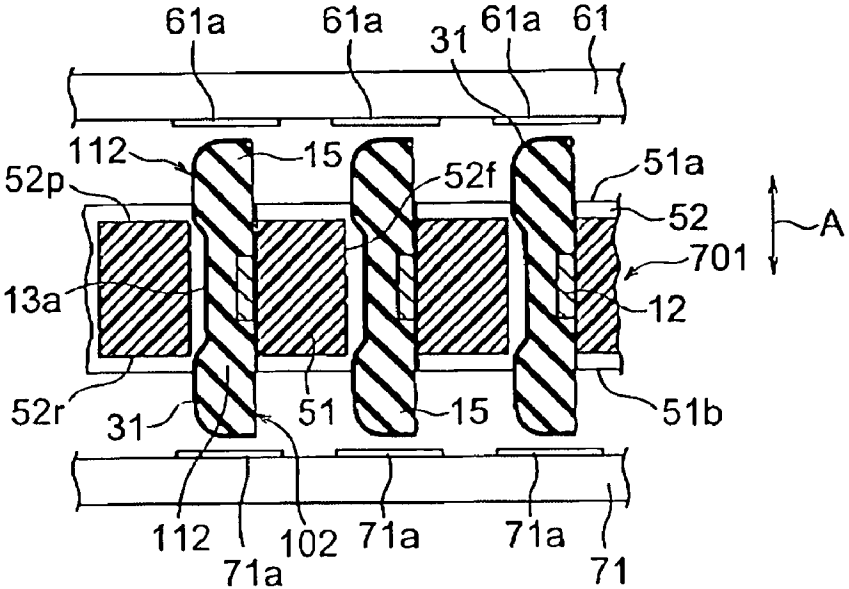

FIG. 19A shows a connector 701 according to a tenth exemplary embodiment of this invention, wherein the connector 701 includes the connecting members 102 shown in FIG. 8 and a plate-shaped holding member 51 holding the connecting members 102.

The holding member 51 has a plurality of accommodating portions 52 for accommodating the connecting members 102 individually. Each accommodating portion 52 vertically passes through the holding member 51 including its upper and lower surfaces 51*a* and 51*b* opposed to each other.

Each accommodating portion 52 includes a first wall 52*d*, a second wall 52*f*, and restraining portions 52*p* and 52*r*.

The first wall 52*d* and the second wall 52*f* are parallel to each other. The restraining portion 52*p* is a surface located below the upper surface 51*a* of the holding member 51 and parallel to the upper surface 51*a*. The other restraining portion 52*r* is a surface located above the lower surface 51*b* of the holding member 51 and parallel to the lower surface 51*b*. Therefore, the restraining portions 52*p* and 52*r* are located in each accommodating portion 52.

Each connecting member 102 is inserted and held between the first wall 52*d* and the second wall 52*f* so as to face the first wall 52*d* and the second wall 52*f*, respectively. In this state, one of the projecting portions 15 of the connecting member 102 is located above the upper surface 51*a* of the holding member 51 while, the other projecting portion 15 of the connecting member 102 is located below the lower surface 51*b* of the holding member 51. Although FIG. 19A does not show the film 21 of any of the connecting members 102, the connecting members 102 each have the same structure as that of the connecting member 102 shown in FIG. 8.

A connection object 61 and a mating connection object 71 are placed parallel to each other. The connector 701 is placed in the connecting direction A so that the pair of projecting portions 15 of each connecting member 102 are located on the upper and lower sides.

Those portions, disposed at the projecting portion 15 on one side, of the conductors 31 are brought into contact with corresponding contact portions 61*a* of the connection object 61. On other hand, those portions, disposed at the projecting portion 15 on the other side, of the conductors 31 are brought into contact with corresponding mating contact portions 71*a* of the mating connection object 71. That is, by relatively moving the connection object 61 and the mating connection object 71 so as to shorten the distance therebetween, the connection object 61 and the mating connection object 71 are brought into contact with the conductors 31 as shown in FIG. 19B to be connected together.

As shown in FIG. 19B, the connection object 61 and the mating connection object 71 are relatively moved so as to shorten the distance therebetween. In this event, the connecting members 102 are compressed in the connecting direction A by the connection object 61 and the mating connection object 71. At the time of the compression, the contact portions 61*a* and the mating contact portions 71*a* are brought into contact with the conductors 31. Simultaneously, portions of each pair of projecting portions 15 are deformed in predetermined directions due to the compression so as to move into spaces defined on the restraining portions 52*p* and 52*r* of the accommodating portion 52. That is, the spaces on the restraining portions 52*p* and 52*r* of the accommodating portion 52 serve as escape portions into which the portions of each pair of projecting portions 15 are allowed to move due to the compression.

The deformed portions of the projecting portions 15 move in the predetermined directions into the spaces on the restraining portions 52*p* and 52*r* after the connection object 61 and the mating connection object 71 are connected together by the connecting members 102. Therefore, the conductors 31 of the adjacent connecting members 102 are prevented from being short-circuited with each other.

Further, at the time of the connection, even if the pitch of the contact portions 61*a* and the pitch of the mating contact portions 71*a* are narrow, the portions of each pair of projecting portions 15 move into the spaces on the restraining portions 52*p* and 52*r* due to the compression. Therefore, the conductors 31 of each connecting member 102 can be prevented from short-circuiting the adjacent contact portions 61*a* in the pitch direction and short-circuiting the adjacent mating contact portions 71*a* in the pitch direction.

In the connector 701 of the tenth exemplary embodiment, even if the grooves 17 or the grooves 17 and the cutout portions 23 are added like the connecting member 103 or 104 shown in FIGS. 9 and 10 or FIG. 11, the connection state shown in FIG. 19B is achieved.

Therefore, when the structure of the connecting member 103 or 104 is employed, it is possible to obtain the same effect as that described above with reference to FIG. 19B.

Accordingly, the connecting member 103 or 104 described above with reference to FIGS. 9 and 10 or FIG. 11 can be used as one component of the connector 701 described above with reference to FIG. 19A as the tenth exemplary embodiment.

Eleventh Exemplary Embodiment

Figure 20B:
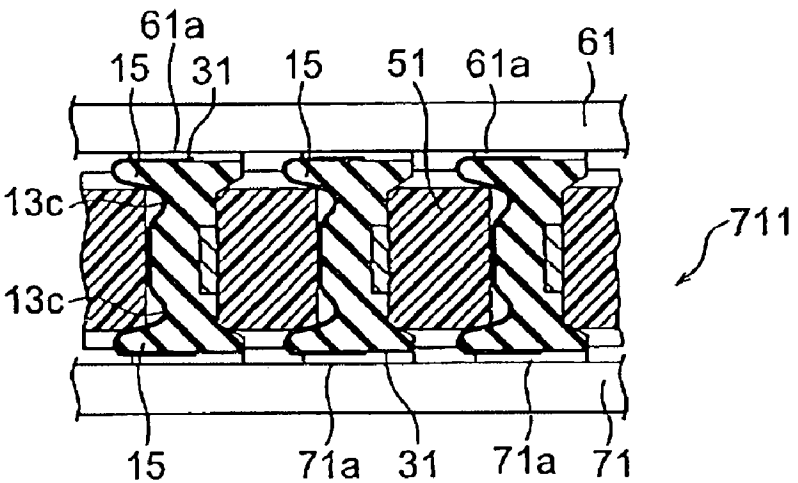
Figure 20A:
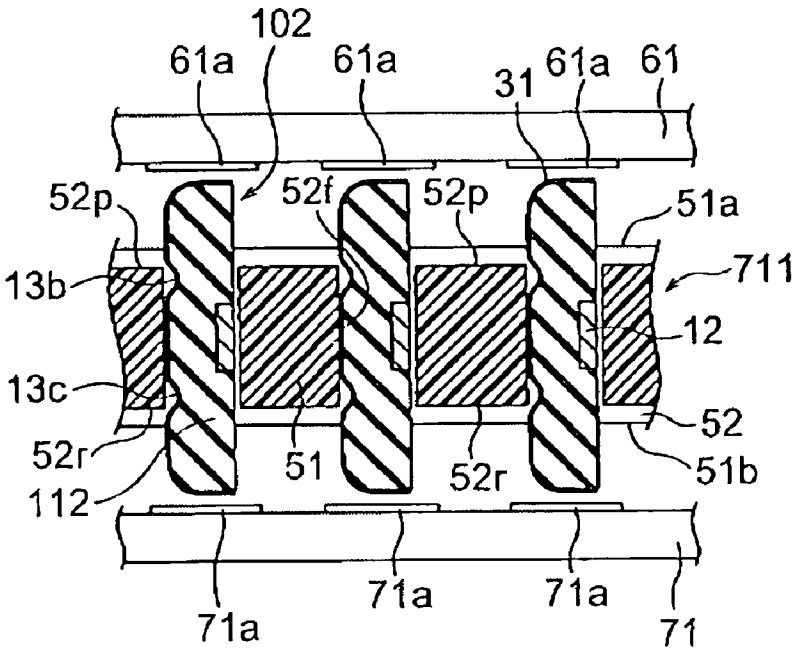

FIG. 20A shows a connector 711 according to an eleventh exemplary embodiment of this invention. The connector 711 differs from the connector 701 in the tenth exemplary embodiment of FIG. 19A only in the connecting members 102. Therefore, the same reference symbols are assigned to the same portions as those of the connector 701 shown in FIG. 19A, thereby omitting explanation thereof.

Referring to FIG. 20A, an elastic body 112 of each connecting member 102 is formed with two escape grooves 13*b* and 13*c* on a holding surface 13 thereof. The escape grooves 13*b* and 13*c* are located in the middle of the holding surface 13 in a width direction perpendicular to a longitudinal direction of the elastic body 112 and each extend in the longitudinal direction of the elastic body 112. The escape grooves 13*b* and 13*c* are located at a predetermined distance from each other in the connecting direction A. The film 21 described above with reference to FIG. 8 is held on the elastic body 112 so as to cover the holding surface 13 including the escape grooves 13*b* and 13*c*, curved surfaces 15*a*, and side surfaces 15*b* of the elastic body 112.

As shown in FIG. 20B, when a connection object 61 and a mating connection object 71 are relatively moved so as to shorten the distance therebetween, the connecting members 102 are compressed in the connecting direction A by the connection object 61 and the mating connection object 71. In this event, contact portions 61*a* of the connection object 61 and mating contact portions 71*a* of the mating connection object 71 are brought into contact with the conductors 31. Simultaneously, portions of each pair of projecting portions 15 are deformed in predetermined directions due to the compression so as to move into spaces defined on restraining portions 52*p* and 52*r* of an accommodating portion 52. That is, the spaces on the restraining portions 52*p* and 52*r* of the accommodating portion 52 serve as escape portions into which the portions of each pair of projecting portions 15 are allowed to move due to the compression.

Since the deformed portions of the projecting portions 15 move in the predetermined directions into the spaces on the restraining portions 52*p* and 52*r* after the connection object 61 and the mating connection object 71 are connected together by the connecting members 102, the conductors 31 of the adjacent connecting members 102 are prevented from being short-circuited with each other.

Further, at the time of the connection, even if the pitch of the contact portions 61*a* and the pitch of the mating contact portions 71*a* are narrow, the portions of each pair of projecting portions 15 move into the spaces on the restraining portions 52*p* and 52*r* due to the compression. Therefore, the conductors 31 of each connecting member 102 can be prevented from short-circuiting the adjacent contact portions 61*a* in the pitch direction and short-circuiting the adjacent mating contact portions 71*a* in the pitch direction.

In the connector 711 of the eleventh exemplary embodiment, even if the grooves 17 or the grooves 17 and the cutout portions 23 are added like the connecting member 103 or 104 shown in FIGS. 9 and 10 or FIG. 11, the connection state shown in FIG. 20B is achieved.

Therefore, when the structure of the connecting member 103 or 104 is employed, it is possible to obtain the same effect as that described above with reference to FIG. 20B.

Accordingly, the connecting member 103 or 104 described above with reference to FIGS. 9 and 10 or FIG. 11 can be used as one component of the connector 711 described above with reference to FIG. 20A as the eleventh exemplary embodiment.

Twelfth Exemplary Embodiment

Figure 21B:
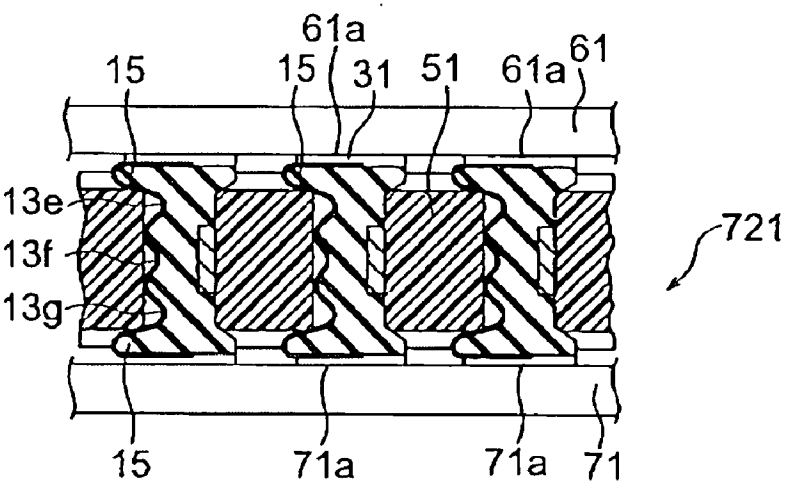
Figure 21A:
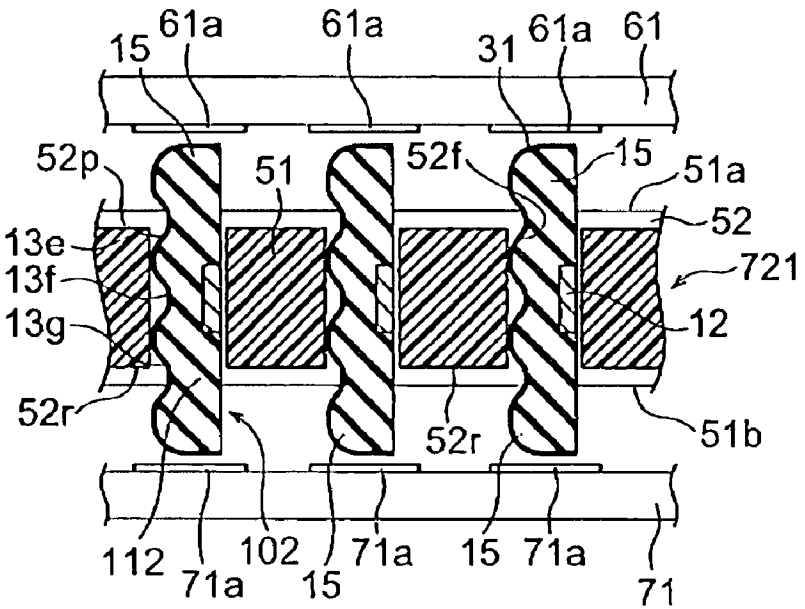

FIG. 21A shows a connector 721 according to a twelfth exemplary embodiment of this invention. The connector 721 differs from the connector 701 in the tenth exemplary embodiment of FIG. 19A only in the connecting members 102. Therefore, the same reference symbols are assigned to the same portions as those of the connector 701 shown in FIG. 19A, thereby omitting explanation thereof.

Referring to FIG. 21A, an elastic body 112 of each connecting member 102 is formed with three escape grooves 13*e*, 13*f*, and 13*g* on a holding surface 13 thereof. The escape grooves 13*e*, 13*f*, and 13*g* are located in the middle of the holding surface 13 in a width direction perpendicular to a longitudinal direction of the elastic body 112 and each extend in the longitudinal direction of the elastic body 112. The escape grooves 13*e*, 13*f*, and 13*g* are located at a predetermined distance from each other in the connecting direction A. The film 21 shown in FIG. 8 is held on the elastic body 112 so as to cover the holding surface 13 including the escape grooves 13*e*, 13*f*, and 13*g*, curved surfaces 15*a*, and side surfaces 15*b* of the elastic body 112.

As shown in FIG. 21B, when a connection object 61 and a mating connection object 71 are relatively moved so as to shorten the distance therebetween, the connecting members 102 are compressed in the connecting direction A by the connection object 61 and the mating connection object 71. In this event, contact portions 61*a* of the connection object 61 and mating contact portions 71*a* of the mating connection object 71 are brought into contact with the conductors 31. Simultaneously, portions of each pair of projecting portions 15 are deformed in predetermined directions due to the compression so as to move into spaces defined on restraining portions 52*p* and 52*r* of an accommodating portion 52. That is, the spaces on the restraining portions 52*p* and 52*r* of the accommodating portion 52 serve as escape portions into which the portions of each pair of projecting portions 15 are allowed to move due to the compression.

Since the deformed portions of the projecting portions 15 move in the predetermined directions into the spaces on the restraining portions 52*p* and 52*r* after the connection object 61 and the mating connection object 71 are connected together by the connecting members 102, the conductors 31 of the adjacent connecting members 102 are prevented from being short-circuited with each other.

Further, at the time of the connection, even if the pitch of the contact portions 61*a* and the pitch of the mating contact portions 71*a* are narrow, the portions of each pair of projecting portions 15 move into the spaces on the restraining portions 52*p* and 52*r* due to the compression. Therefore, the conductors 31 of each connecting member 102 can be prevented from short-circuiting the adjacent contact portions 61*a* in the pitch direction and short-circuiting the adjacent mating contact portions 71*a* in the pitch direction.

In the connector 721 of the twelfth exemplary embodiment, even if the grooves 17 or the grooves 17 and the cutout portions 23 are added like the connecting member 103 or 104 shown in FIGS. 9 and 10 or FIG. 11, the connection state shown in FIG. 21B is achieved.

Therefore, when the structure of the connecting member 103 or 104 is employed, it is possible to obtain the same effect as that described above with reference to FIG. 21B.

Accordingly, the connecting member 103 or 104 described above with reference to FIGS. 9 and 10 or FIG. 11 can be used as one component of the connector 721 described above with reference to FIG. 21A as the twelfth exemplary embodiment.

In each of the first to twelfth exemplary embodiments, it is preferable to properly change the thickness of the elastic body 11 or 112 between the base surface 14 and the holding surface 13 or at each projecting portion 15. By adjusting the thickness of the elastic body 11 or 112 at each projecting portion 15, the movement of each projecting portion 15 into the space on the restraining portion 52*h*, 52*j*, 52*n*, 52*p*, or 52*r* can be stably achieved.

In each exemplary embodiment, the connecting member 1, 101, 102, 103, or 104 can be adapted to the layout of the connection object 61 and the mating connection object 71 or the number of the contact portions 61*a* or the mating contact portions 71*a*.

Further, since the connector structure can be formed by holding the connecting member/members 1, 101, 102, 103, or 104 in the accommodating portion/portions 52, the connector has wide flexibility and is excellent in productivity.

Even in the case of the connector 401 in the third exemplary embodiment of FIG. 7A, a connector can be obtained using any of the connecting members 102, 103, and 104.

Further, by forming the restraining portions, adapted to control the deformation of the elastic connecting member caused by the compression at the time of the connection, at the holding member holding such an elastic connecting member, the pressure contact loads of the connector can be made stable, thereby improving the contact reliability.

Further, by forming at the holding member the restraining portions adapted to control the deformation caused by the compression at the time of the connection, it is possible to prevent a short circuit between the adjacent contact portions of the connection object and a short circuit between the adjacent mating contact portions of the mating connection object.

The foregoing connector is applicable as a connector for use in electrical connection between an IC chip, a flexible printed wiring board, or the like and a wiring board, a subcarrier, or the like.

Further, the connector is applicable as a connector for LGA (land grid array) or BGA (ball grid array) chips.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. An electrical connector for connecting connection objects to each other in a connecting direction, said electrical connector comprising:

a holding member having an accommodating portion between a first and a second surface to which said connection objects are opposed, respectively, when connected to said electrical connector; and a connecting member having elasticity and placed in said accommodating portion, wherein said holding member comprises a first and a second wall which define said accommodating portion therebetween, said second wall comprises a pair of restraining portions defining spaces which extend along the first and the second surfaces, respectively, each of the spaces allows portions of said connecting member to elastically move in a predetermined direction crossing said connecting direction, each of said restraining portions comprises an inclined surface which is inclined with respect to said connecting direction to make each of said spaces be taper-shaped so as to enlarge said accommodating portion only in the vicinity of said first and second surfaces, wherein said connecting member comprises a conductor formed to come in face-to-face contact with said connection objects.

2. The electrical connector according to claim 1, wherein said connecting member further comprises:

an elastic body;

wherein said conductor is disposed at a predetermined position on said elastic body.

3. The electrical connector according to claim 2, wherein said elastic body comprises:

a base surface facing said first wall;

a holding surface facing said second wall;

projecting base surfaces extending from both sides of said base surface, respectively;

curved surfaces extending from both sides of said holding surface, respectively; and side surfaces each connecting a corresponding one of said projecting base surfaces and a corresponding one of said curved surfaces to each other, wherein said conductor is disposed on said holding surface, said curved surfaces, and said side surfaces.

4. The electrical connector according to claim 3, wherein said elastic body has an elongated plate shape, said conductor comprises a plurality of conductors arranged in a predetermined pattern at a predetermined distance from each other in a longitudinal direction of said elastic body, and further, each of said plurality of conductors is arranged in a predetermined pattern in a width direction perpendicular to said longitudinal direction.

5. The electrical connector according to claim 1, wherein said connecting member comprises:

an elastic body; and a film disposed at a predetermined position on said elastic body;

wherein said conductor is arranged in a predetermined pattern on said film.

6. The electrical connector according to claim 5, wherein said elastic body comprises:

a base surface facing said first wall, a holding surface facing said second wall;

projecting base surfaces extending from both sides of said base surface, respectively;

curved surfaces extending from both sides of said holding surface, respectively; and side surfaces each connecting a corresponding one of said projecting base surfaces and a corresponding one of said curved surfaces to each other, wherein said film is fixedly bonded to said holding surface, said curved surfaces, and said side surfaces.

7. The electrical connector according to claim 6, wherein said elastic body is formed with grooves at said projecting base surfaces, said curved surfaces, and said side surfaces excluding said curved surfaces and said side surfaces facing said conductor.

8. An electrical connector for connecting connection objects to each other in a connecting direction, said electrical connector comprising:

a holding member having an accommodating portion between a first and a second surface to which said connection objects are opposed, respectively, when connected to said electrical connector; and a connecting member having elasticity and placed in said accommodating portion, wherein said holding member comprises a first and a second wall which define said accommodating portion therebetween, at least one of said first and second walls comprises a restraining portion defining a space which allows a portion of said connecting member to elastically move in a predetermined direction crossing said connecting direction, wherein said connecting member comprises:

an elastic body; and a conductor disposed at a predetermined position on said elastic body, wherein said elastic body comprises:

a base surface facing said first wall;

a holding surface facing said second wall;

projecting base surfaces extending from both sides of said base surface, respectively;

curved surfaces extending from both sides of said holding surface, respectively; and side surfaces each connecting a corresponding one of said projecting base surfaces and a corresponding one of said curved surfaces to each other, wherein said conductor is disposed on said holding surface, said curved surfaces, and said side surfaces, wherein said elastic body has an elongated plate shape, said conductor comprises a plurality of conductors arranged in a predetermined pattern at a predetermined distance from each other in a longitudinal direction of said elastic body, and further, each of said plurality of conductors is arranged in a predetermined pattern in a width direction perpendicular to said longitudinal direction, and wherein said holding surface is formed with at least one escape groove located in said width direction and extending parallel to said longitudinal direction.

9. An electrical connector for connecting connection objects to each other in a connecting direction, said electrical connector comprising:

a holding member having an accommodating portion between a first and a second surface to which said connection objects are opposed, respectively, when connected to said electrical connector; and a connecting member having elasticity and placed in said accommodating portion, wherein said holding member comprises a first and a second wall which define said accommodating portion therebetween, at least one of said first and second walls comprises a restraining portion defining a space which allows a portion of said connecting member to elastically move in a predetermined direction crossing said connecting direction, wherein said connecting member comprises;

an elastic body; and a film disposed at a predetermined position on said elastic body;

wherein said conductor is arranged in a predetermined pattern on said film, wherein said elastic body comprises:

a base surface facing said first wall, a holding surface facing said second wall;

projecting base surfaces extending from both sides of said base surface, respectively;

curved surfaces extending from both sides of said holding surface, respectively; and side surfaces each connecting a corresponding one of said projecting base surfaces and a corresponding one of said curved surfaces to each other, wherein said film is fixedly bonded to said holding surface, said curved surfaces, and said side surfaces, wherein said elastic body is formed with grooves at said projecting base surfaces, said curved surfaces, and said side surfaces excluding said curved surfaces and said side surfaces facing said conductor, and wherein said film is formed with cutout portions by cutting out portions, facing said grooves, of said film.

10. The electrical connector according to claim 9, wherein said elastic body has an elongated plate shape, said conductor comprises a plurality of conductors arranged on said film in a predetermined pattern at a predetermined distance from each other in a longitudinal direction of said elastic body, and further, each of said plurality of conductors is arranged on said film in a predetermined pattern in a width direction perpendicular to said longitudinal direction.

11. The electrical connector according to claim 9, wherein said holding surface is formed with at least one escape groove located in said width direction and extending parallel to said longitudinal direction.

12. An electrical connector for connecting connection objects to each other in a connecting direction, said electrical connector comprising:

a holding member having an accommodating portion between a first and a second surface to which said connection objects are opposed, respectively, when connected to said electrical connector; and a connecting member having elasticity and placed in said accommodating portion, wherein said holding member comprises a first and a second wall which define as part of said accommodating portion therebetween, said second wall comprises a pair of restraining portions defining spaces which extend along the first and second surfaces, respectively, each of the spaces allows portions of said connecting member to elastically move in a predetermined direction crossing said connecting direction, each of said restraining portions comprises a stepped surface formed parallel to said pair of surfaces so as to enlarge said accommodating portion only in the vicinity of said first and second surfaces, wherein said second wall further comprises a protruding portion projecting toward said connecting member between said restraining portions, wherein said connecting member comprises a conductor formed to come in face-to-face contact with said connection objects.

13. The electrical connector according to claim 12, wherein said restraining portion comprises an inclined surface inclined with respect to said connecting direction so as to enlarge said space in the vicinity of said accommodating portion.

14. The electrical connector according to claim 12, wherein said restraining portion comprises a flat surface formed perpendicular to said connecting direction.

15. The electrical connector according to claim 12, wherein said connecting member comprises:

an elastic body;

wherein said conductor is disposed at a predetermined position on said elastic body.

16. The electrical connector according to claim 15, wherein said elastic body comprises:

a base surface facing said first wall;

a holding surface facing said second wall;

projecting base surfaces extending from both sides of said base surface, respectively;

curved surfaces extending from both sides of said holding surface, respectively; and side surfaces each connecting a corresponding one of said projecting base surfaces and a corresponding one of said curved surfaces to each other, wherein said conductor is disposed on said holding surface, said curved surfaces, and said side surfaces.

17. The electrical connector according to claim 16, wherein said elastic body has an elongated plate shape, said conductor comprises a plurality of conductors arranged in a predetermined pattern at a predetermined distance from each other in a longitudinal direction of said elastic body, and further, each of said plurality of conductors is arranged in a predetermined pattern in a width direction perpendicular to said longitudinal direction.

18. The electrical connector according to claim 17, wherein said holding surface is formed with at least one escape groove located in said width direction and extending parallel to said longitudinal direction.

19. The electrical connector according to claim 12, wherein said connecting member comprises:

an elastic body; and a film disposed at a predetermined position on said elastic body;

wherein said conductor is arranged in a predetermined pattern on said film.

20. The electrical connector according to claim 19, wherein said elastic body comprises:

a base surface facing said first wall, a holding surface facing said second wall;

projecting base surfaces extending from both sides of said base surface, respectively;

curved surfaces extending from both sides of said holding surface, respectively; and side surfaces each connecting a corresponding one of said projecting base surfaces and a corresponding one of said curved surfaces to each other, wherein said film is fixedly bonded to said holding surface, said curved surfaces, and said side surfaces.

21. The electrical connector according to claim 20, wherein said elastic body has an elongated plate shape, said conductor comprises a plurality of conductors arranged on said film in a predetermined pattern at a predetermined distance from each other in a longitudinal direction of said elastic body, and further, each of said plurality of conductors is arranged on said film in a predetermined pattern in a width direction perpendicular to said longitudinal direction.

22. The electrical connector according to claim 21, wherein said holding surface is formed with at least one escape groove located in said width direction and extending parallel to said longitudinal direction.

23. The electrical connector according to claim 20, wherein said elastic body is formed with grooves at said projecting base surfaces, said curved surfaces, and said side surfaces excluding said curved surfaces and said side surfaces facing said conductor.

24. The electrical connector according to claim 23, wherein said film is formed with cutout portions by cutting out portions, facing said grooves, of said film.

* * * * *